US006823159B2

(12) United States Patent
Sakai et al.

(10) Patent No.: US 6,823,159 B2
(45) Date of Patent: Nov. 23, 2004

(54) IMAGE FORMING APPARATUS AND PROCESS CARTRIDGE INCLUDING A DEVELOPING DEVICE PROVIDED AT LEAST WITH A DEVELOPER HOLDING MEMBER FOR HOLDING A DEVELOPER CONTAINING A TONER AND A DEVELOPER REGULATING MEMBER

(75) Inventors: Hiroaki Sakai, Shizuoka (JP); Seiji Saito, Shizuoka (JP); Takeshi Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 09/987,297

(22) Filed: Nov. 14, 2001

(65) Prior Publication Data

US 2002/0106219 A1 Aug. 8, 2002

(30) Foreign Application Priority Data

Nov. 16, 2000 (JP) ..... 2000/349802

(51) Int. Cl.[7] ..... G03G 15/08; G03G 15/06; G03G 9/08

(52) U.S. Cl. ..... 399/222; 430/110.3; 430/110.4; 430/111.4

(58) Field of Search ..... 399/222; 430/111.4, 430/105, 110.3, 110.1, 110.4

(56) References Cited

U.S. PATENT DOCUMENTS

| | | | | |
|---|---|---|---|---|
| 4,292,387 A | | 9/1981 | Kanbe et al. | 430/102 |
| 4,356,245 A | | 10/1982 | Hosono et al. | 430/122 |
| 4,395,476 A | | 7/1983 | Kanbe et al. | 430/102 |
| 4,913,088 A | | 4/1990 | Kanbe et al. | 399/270 |
| 5,096,798 A | | 3/1992 | Kanbe et al. | 430/120 |
| 5,194,359 A | | 3/1993 | Kanbe et al. | 430/120 |
| 5,643,704 A | * | 7/1997 | Tamura et al. | |
| 6,002,900 A | * | 12/1999 | Ishiyama | 430/110.4 |
| 6,033,817 A | * | 3/2000 | Yusa et al. | 430/110.4 |
| 6,528,224 B2 | * | 3/2003 | Ohno et al. | 430/110.1 |
| 6,537,715 B2 | * | 3/2003 | Mizoo et al. | 430/110.3 |
| 2001/0033983 A1 | * | 10/2001 | Ohno et al. | 430/110.3 |
| 2003/0054278 A1 | * | 3/2003 | Naka et al. | 430/110.3 |

FOREIGN PATENT DOCUMENTS

| | | | |
|---|---|---|---|
| JP | 54-42141 | | 4/1979 |
| JP | 55-18656 | | 2/1980 |
| JP | 11-72961 | * | 3/1999 |

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes an electrophotographic photosensitive member rotated at a peripheral speed of 150 mm/second or more and a specific toner. The toner has a weight-average particle diameter from 5 to 12 $\mu$m, and of the toner having a circle-equivalent diameter of 3 $\mu$m or more, particles with a circularity of 0.900 or more are present at a rate of 90% or more in a number-based cumulative valve. The toner also satisfies one of two sets of conditions defined by the relationship between a cut rate and a weight-average particle diameter and the relationship between a number-based cumulative valve and a weight-average particle diameter. The cut rate Z is represented by the expression:

$$Z=(1-B/A)\times 100$$

wherein A is a concentration of all the measured particles and B is a concentration of the measured particles whose circle-equivalent diameters are 3 $\mu$m or more.

2 Claims, 15 Drawing Sheets

IMAGE FORMING APPARATUS AND PROCESS CARTRIDGE INCLUDING A DEVELOPING DEVICE PROVIDED AT LEAST WITH A DEVELOPER HOLDING MEMBER FOR HOLDING A DEVELOPER CONTAINING A TONER AND A DEVELOPER REGULATING MEMBER

FILED OF THE INVENTION AND RELATED ARTS

The present invention relates to an image forming apparatus such as an electrophotographic copier or a laser beam printer, and a process cartridge for use therein.

Electrophotographic image forming apparatus using an electrophotographic image forming process conventionally employ a process-cartridge method of integrating an electrophotographic photosensitive member with a process means acting thereon to form a cartridge that can be installed in and removed from an image forming apparatus. This process-cartridge method enables a user to perform the maintenance of the apparatus without relying on service personnel, thereby drastically improving operability. Thus, this process-cartridge method is widely used for electrophotographic image forming apparatus.

The process-cartridge method comprises integrating a charging or cleaning means with a developing means and an electrophotographic photosensitive drum to form a cartridge that can be installed in and removed from the image forming apparatus main body. Alternatively, at least one of the charging and cleaning means is integrated with the developing means or the electrophotographic photosensitive drum to form a cartridge that can be installed in and removed from the image forming apparatus main body. The process-cartridge method may alternatively comprise integrating at least the developing means and the electrophotographic photosensitive member together to form a cartridge that can be installed in and removed from the image forming apparatus main body.

Such a process-cartridge comprises a developing member and a developer containing toner, functioning as a developing means.

FIG. 8 shows a conventional example of a laser printer as an image forming apparatus to which the process-cartridge method is applied. This image forming apparatus comprises a photosensitive drum 1 functioning as an electrophotographic photosensitive member, an exposure device 2 functioning as a static-latent-image forming means, a developing device 3 functioning as a developing means, a transfer member 4 functioning as a transfer means, a cleaning device 5 functioning as a cleaning means, a charging member 6 functioning as a charging means, a fixing device 7, a sheet feeding cassette B in which transfer materials to be supplied are placed, and a sheet feeding device 8. In FIG. 8, reference character P denotes a passage through which transfer materials are conveyed, and reference character L denotes a laser beam from the exposure device 2. In this case, the photosensitive drum 1, the developing device 3, the cleaning device 5, and the charging member 6 are integrally supported to form a process cartridge.

The exposure device 2 turns on and off a laser beam L corresponding to image information to apply it to a surface of the photosensitive drum 1, which has been charged to a desired potential by the charging member 6. Thus, the charges are eliminated to form a static latent image on the photosensitive drum 1.

The developing device 3 comprises a cylindrical metal developer holding member (hereinafter referred to as a "developing sleeve") 31 arranged opposite to the photosensitive drum 1 in a developing container. The developing sleeve 31 is coated with coarse particles such as polymethyl methacrylate resin (PMMA) or spherical carbon particles and a thin conductive layer composed of a composite material consisting of a binding resin, carbon black, and carbon graphite. An elastic blade 32 having an elastic member, such as urethane rubber, is arranged as a developer regulating member to form a nip portion between the developing sleeve 31, and the elastic blade 32 (hereinafter referred to as a "developing blade"), so that the nip portion is used to form a thin layer of a developer on the developing sleeve 31, thereby allowing the developer to be charged. The toner in the developer is supplied from the developing sleeve 31 depending on the static latent image to form a toner image on the photosensitive drum 1.

In general, the developer is produced using as materials a binding resin that fixes the developer to a transferred material, various coloring materials that provide the tones of toner, and a charge-control agent that applies charges to particles. In the case of a one-component developer, such as those shown in Japanese Patent Application Laid-Open Nos. 54-42141 and 55-18656, the toner itself comprises a magnetic material so as to be conveyable. Furthermore, another additive such as a releasing agent, is added to and dry-mixed with the toner as required. Subsequently, the mixture is melted and kneaded by a general-purpose kneading apparatus, such as a roll mill or an extruder, and is then cooled and solidified. Then, the kneaded mixture is crushed by any crushing apparatus, such as a jet stream crusher and a mechanical collision crusher, and the fine crushed pieces so obtained are introduced into any pneumatic classifier for classification. Thus, toner particles with an equal required size are obtained, and a fluidizing agent or a lubricant is dry-mixed with the particles to obtain toner for use in image formation.

Further, for a two-component developer, any magnetic holding member and the above-described toner are mixed together, and the mixture is used to form an image.

The transfer material 4 allows a toner image on the photosensitive drum 1 to be transferred to the surface of the transfer material. This unfixed toner image on the transfer material is heated and pressurized by the fixing device 7 so as to be permanently fixed to the transfer material, and the transfer material is then discharged from the image forming apparatus.

On the other hand, toner or paper dust remaining on the photosensitive drum 1 after transfer is cleaned by the cleaning device 5. Further, a residue checking bar 11 is used to detect a change in the static capacity between the bar and the developing sleeve 31 to detect the amount of remaining toner.

A developing section formed of the photosensitive drum and the developing sleeve, which are opposite to each other, depends on the construction of the developing device. Accordingly, the same developing device construction may not ensure a sufficient developing capability for an image forming apparatus with an increased speed (process speed). FIG. 9 shows the relationship between the number of sheets printed and the sheet-image-reflection density as observed if conventional toner, having a lower circularity as described above, is used as a developer. Here, a reflection densitometer X-Rite504 manufactured by X-Rite Co., Ltd. was used to measure the image-reflection density. In this plot, the squares denote the transition of the density observed at a process speed (the peripheral speed of the photosensitive member) of 100 mm/sec., the triangles denote the transition of the density observed at a process speed of 150 mm/sec., and the circles denote the transition of the density observed at a process speed of 200 mm/sec. The construction of the developing device is as shown in the conventional example; the photosensitive drum had a diameter of 30 mm, the developing sleeve had a diameter of 20 mm, and the ratio of the peripheral speed of the developing sleeve to that of the photosensitive drum is set at 1.2:1. With a lower toner circularity, the toner adheres more firmly to the developing sleeve and is more unlikely to fly therefrom when electric fields are applied thereto, and the process speed also increases. An appropriate density (reflection density: 1.35 or more and preferably 1.40 or more) can be maintained only at a process speed of 150 mm/sec. or less, and the device construction must be adapted to a higher process speed.

The reason why the developing capability is degraded as the process speed increases is a decrease in the time required for the developer to pass through the developing section. Thus, efforts have been made to increase the diameter of the developing sleeve or the peripheral speed of the developing speed with respect to the photosensitive drum. However, it should be appreciated that an increase in the size of the device leads to an increase in the size of the image forming apparatus main body. Further, an increase in the peripheral speed of the developing speed with respect to the photosensitive drum results in a decrease in the lifetime of the developing sleeve or an increase in mechanical loads on the toner, thereby degrading the developing capability.

SUMMARY OF THE INVENTION

The object of the present invention is to provide an image forming apparatus and a process cartridge using toner that ensures a sufficient developing capability without reducing the lifetime of a developing sleeve even when the process speed (the peripheral speed of a photosensitive member) is increased.

The present invention provides an image forming apparatus comprising an electrophotographic photosensitive member, a charging means for applying voltage to a charge member to charge the electrophotographic photosensitive member, a static latent image forming means for forming a static latent image on the charged electrophotographic photosensitive member, and a developing means for developing the electrostatic latent image, wherein the developing means is provided with at least a developer holding member for holding a developer containing a toner on its surface and a developer regulating member for regulating a layer thickness of a developer layer on the developer holding member, the electrophotographic photosensitive member and the developer holding member are set opposite to each other to form a developing section, the developer regulating member regulates the developer to form a thin layer of the developer on the developer holding member surface, and in the developing section, the toner in the developer is transferred to the electrostatic latent image held on the surface of the electrophotographic photosensitive member to form a toner image, the peripheral speed of the electrophotographic photosensitive member is 150 mm/second or more, the toner has a weight-average particle diameter of from 5 to 12 $\mu$m, and of the toner having a circle-equivalent diameter of 3 $\mu$m or more, particles with a circularity a of 0.900 or more found according to formula (1)

$$\text{circularity } a = L0/L \quad (1)$$

(wherein L0 denotes the circumference of a circle having the same projected area as a particle image, and L denotes the circumference of the particle image) are present at a rate of 90% or more in a number-based cumulative value, and the toner satisfies the following conditions i) or ii):

i) the relationship between the cut rate Z and the weight-average particle diameter X of the toner satisfies expression (2)

$$\text{cut rate } Z \leqq 5.3 \times X \quad (2)$$

(wherein the cut rate Z is represented by expression (3)

$$Z = (1 - B/A) \times 100 \quad (3)$$

where A represents the concentration (the number of particles/$\mu$l) of all particles measured with a flow-type particle image analyzer FPIA-1000 manufactured by TOA MEDICAL ELECTRONICS CO.,LTD., and B represents the concentration (the number of particles/$\mu$l) of the measured particles the circle-equivalent diameters of which are 3 $\mu$m or more), and the relationship between the number-based cumulative value Y of particles having a circularity of 0.950 or more and the weight-average particle diameter X of the toner satisfies expression (4)

$$Y \geqq \exp 5.51 \times X^{-0.645} \quad (4)$$

(where X is in the range from 5.0 to 12.0 $\mu$m); and ii) the relationship between a cut rate Z and the weight-average particle diameter satisfies expression $$\text{cut rate } Z > 5.3 \times X \quad (5)$$

and the relationship between the number-based cumulative value Y of particles having a circularity of 0.950 or more and a weight-average particle diameter X satisfies expression (6)

$$Y \geqq \exp 5.37 \times X^{-0.545} \quad (6)$$

(where X is in the range from 5.0 to 12.0 $\mu$m).

The present invention also provides a process cartridge comprising an electrophotographic photosensitive member, a charging means for applying voltage to a charge member to charge the electrophotographic photosensitive member, and a developing means for developing an electrostatic latent image, wherein the process cartridge is used for an image forming apparatus in which a toner in a developer is transferred to an static latent image to form a toner image, and the toner image is transferred to a transfer material to form an image, and is so constructed as to be detachably mountable on the apparatus, the developing means is provided with at least a developer holding member for holding a developer containing a toner on its surface and a developer regulating member for regulating a layer thickness of a developer layer on the developer holding member, the electrophotographic photosensitive member and the developer holding member are set opposite to each other to form a developing section, the developer regulating member regulates the developer to form a thin layer of the developer on the developer-holding-member surface, and in the developing section the toner in the developer is transferred to the electrostatic latent image held on the surface of the electrophotographic photosensitive member to form a toner image, the peripheral speed of the electrophotographic photosensitive member is 150 mm/second or more, the toner has a weight-average particle diameter of from 5 to 12 μm, and of the toner having a circle-equivalent diameter of 3 μm or more, particles with a circularity a of 0.900 or more found according to formula (1)

$$\text{circularity } a = L0/L \tag{1}$$

(wherein L0 denotes the circumference of a circle having the same projected area as a particle image, and L denotes the circumference of the particle image) are present at a rate of 90% or more in a number-based cumulative value, and the toner satisfies the above conditions i) or ii).

DETAILED DESCRIPTION OF THE INVENTION

Figure 1:
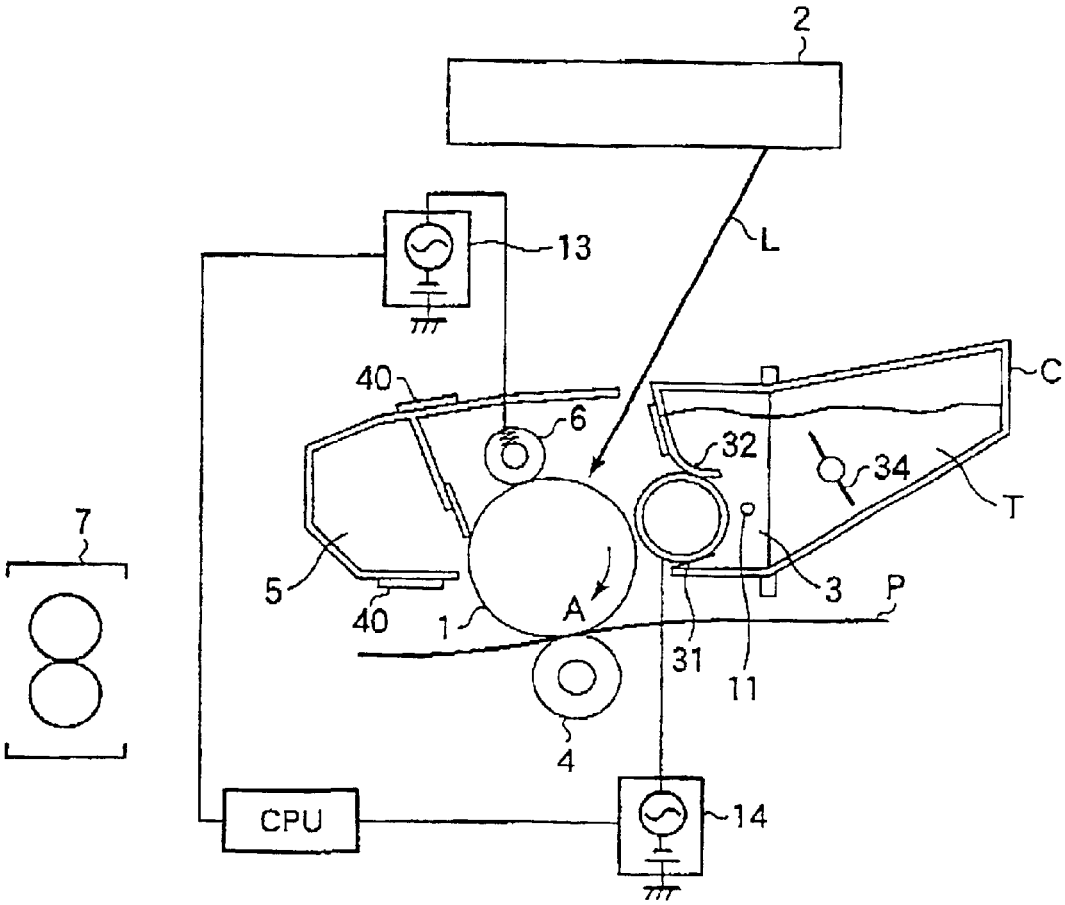
FIG. 1 is a sectional view of an example of an image forming apparatus according to the present invention on which a process cartridge according to the present invention is mounted.

The toner used in the present invention has a weight average particle diameter of 5 to 12 μm and the toner having a circle-equivalent diameter of 3 μm or more has particles having a circularity a of 0.900 or more at a rate of 90% or more in a number-based cumulative value. The circularity can be found according to the following expression (1):

$$\text{Circularity } a = L0/L \tag{1}$$

(L0: peripheral length (circumference) of a circle having the same projected area as a particle image; L: peripheral length of the particle image).

The average circularity of the toner according to the present invention is used as a simple and easy way of quantitatively expressing the shape of particles. In the present invention, the average circularity is defined by a value obtained by measuring particles using a flow-type particle image analyzer FPIA-1000, manufactured by TOA MEDICAL ELECTRONICS CO., LTD., determining the circularity of the measured particles using the above Expression (1), and dividing the sum of the circularities of all the measured particles by the number of all the particles using the following Expression (7):

$$\text{Average circularity } a = \sum_{i=1}^{m} ai/m \tag{7}$$

A circularity standard deviation SD is calculated using the following Expression (8) if the average circularity determined using the above Expressions (1) and (7) is defined as a, the circularity of each particle is defined as ai, and the number of particles measured is defined as m.

$$\text{Circularity standard deviation } SD = \sum_{i=1}^{m} (a - ai)^2/m^{1/2} \tag{8}$$

The circularity in the present invention is an index for the irregularity of the toner; it is 1.00 if the toner is perfectly spherical and decreases as the surface shape becomes more complicated. Further, the standard deviation SD of the circularity distribution in the present invention is an index for variations; the smaller this value, the smaller the variation in the toner shape. In the present invention, the circularity standard deviation SD is preferably between 0.030 and 0.045.

The measuring apparatus "FPIA-1000", used in the present invention, employs a calculation method of calculating the circularity of each particle, subsequently dividing the particle circularity of 0.4 to 1.0 into 61 classes on the basis of the circularity obtained, and then using the median and frequency of the divided points to calculate the average circularity and the circularity standard deviation. However, the difference between the average circularity and circularity standard deviation as calculated using this method and those as calculated using a calculation method of directly using the circularity of each particle is very small and substantially negligible. Thus, for data-handling reasons, e.g., reducing the time required for the calculation or simplifying the operational expressions, the present invention may use an altered version of the calculation method of directly using the circularity of each particle, on the basis of the concept of this method.

The procedures of measurement will be shown below.

About 5 mg of toner is diffused in 10 ml of water having about 0.1 mg of surfactant dissolved therein to prepare a dispersion. The dispersion is sonicated for 5 minutes (200 kHz, 50 W). The concentration of the dispersion is set at 5,000 to 20,000 particles/μl, and the previously described analyzer is used to measure the particles to find the average circularity and circularity standard deviation of the group of particles having a circle-equivalent diameter of 3 μm or more. Since the circularities of all the particles are measured as described above, the number of all the particles measured can be defined as a 100 number % (or % by number) to calculate a number-based cumulative value.

It has been known that the shape of the toner affects its characteristics, and the inventors have found through various examinations that the shape of the toner of 3 μm or more in particle diameter significantly affects its transferring and developing capabilities. The inventors have also found that the transferring and developing capabilities may be degraded when the amount of the group of particles having a circle-equivalent diameter of less than 3 μm exceeds a certain value. That is, it has become clear that when the amount of fine toner powder or fine external additive powder of less than 3 μm in particle diameter reaches a certain value, the desired performance is difficult to realize unless the circularity of toner of 3 μm or more in particle diameter is increased.

Accordingly, it is important to the effects of the present invention that the group of particles having a circle-equivalent diameter of 3 μm or more includes 90% or more, in terms of the number-based cumulative value, of particles having a circularity a of 0.900 or more. However, to more effectively bring out the effects of toner particles having a circle-equivalent diameter of 3 μm or more, which affect the transferring and developing capability, the circularity of toner particles having a circle-equivalent diameter of 3 μm or more must be controlled on the basis of the amount of particles of toner having a circle-equivalent diameter of less than 3 μm as described below.

By controlling the circularity of toner particles having a circle-equivalent diameter of 3 μm or more on the basis of the amount of particles having a circle-equivalent diameter of 3 μm or less, toner having excellent transferring and developing capabilities can be obtained.

In the measurement of the circularity carried out by the analyzer FPIA-1000, used as a circularity measuring apparatus, as the particle diameter decreases, the particle image more closely approximates a point and the circularity tends to increase. Thus, the toner containing a large amount of small particles has a large circularity. In contrast, the toner containing a small amount of small particles has a small circularity. Accordingly, the relationship between a cut rate Z and a weight average particle diameter X is determined in two cases, that is, the above Expressions (2) and (5). The cut rate is calculated according to the expression (3) by subtracting from 100% the ratio of the concentration of the particles having a circle-equivalent diameter of 3 μm or more to the concentration of all the measured particles:

$$\text{Cut rate } Z=(1-B/A)\times 100 \quad (3)$$

(A: concentration of all the particles measured; B: concentration of the particles having a circle-equivalent diameter of 3 μm or more).

In each case, the relationship between the circularity and the weight average particle diameter which is required to meet the desired performance is derived as shown in the above Expression (4) or (6).

In the toner containing a small amount of particles of less than 3 μm, particles having a circle-equivalent diameter of 3 μm or more and a circularity of 0.950 or more may have a number-based cumulative value Y of exp $5.51\times X^{-0.645}$ or more relative to the weight-average particle diameter X. However, in the toner containing a large amount of particles having a circle-equivalent diameter of less than 3 μm, particles having a circle-equivalent diameter of 3 μm or more and a circularity of 0.950 or more must have a larger number-based cumulative value Y, that is, exp $5.37\times X^{-0.545}$ or more, relative to the weight-average particle diameter X.

Figure 2A:
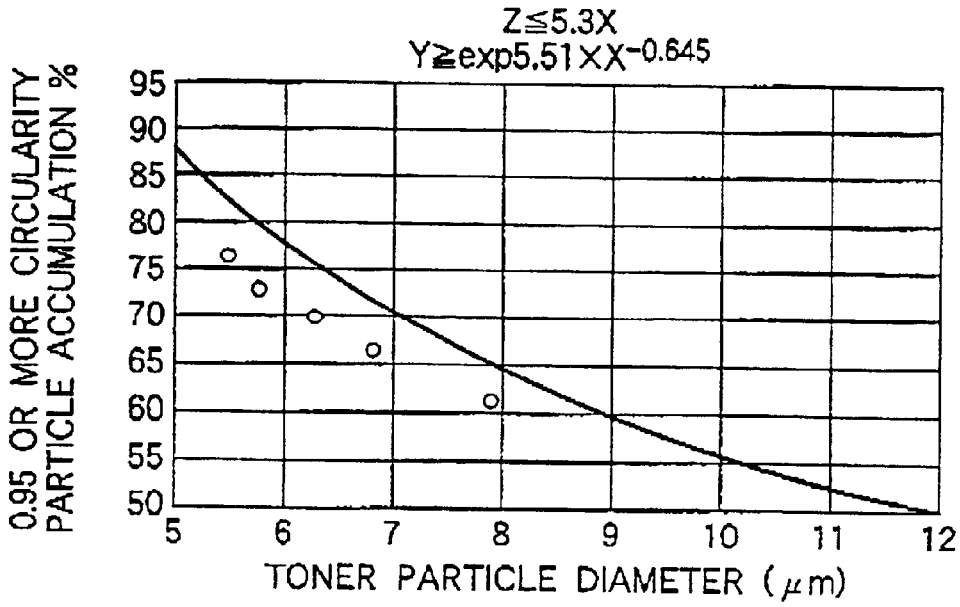
FIGS. 2A and 2B are graphs showing the relationship between the particle size of toner according to the present invention and the accumulated percentage of particles having a circularity of 0.95 or more.

Preferably, the toner used in the present invention contains particles having a circle-equivalent diameter of 3 μm or more including 90% or more, in terms of the number-based cumulative value, of particles having a circularity a of 0.900 or more. Further, if (i) the relationship between the cut rate Z and the toner weight-average particle diameter satisfies the expression: cut rate $Z\leqq 5.3\times X$ (preferably $0<$cut rate $Z\leqq 5.3\times X$), particles having a circularity a of 0.950 or more preferably satisfy the expression: number-based cumulative value $Y\geqq$exp $5.51\times X^{-0.645}$ as shown in FIG. 2A.

Figure 2B:
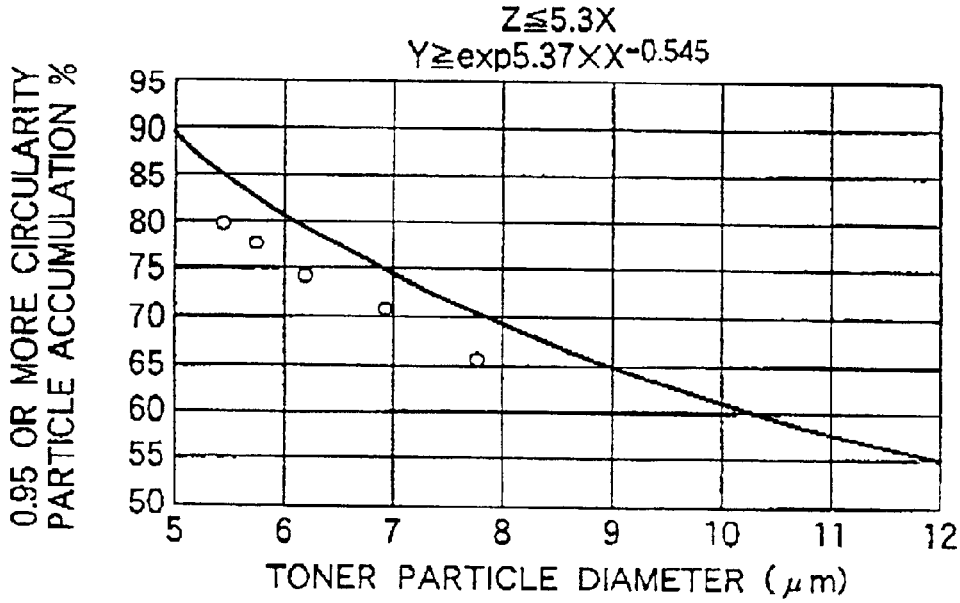

Preferably, the toner used in the present invention contains particles having a circle-equivalent diameter of 3 μm or more including 90% or more, in terms of the number-based cumulative value, of particles having a circularity a of 0.900 or more. Further, if (ii) the relationship between the cut rate Z and the toner weight-average particle diameter satisfies the expression:cut rate $Z>5.3\times X$ (preferably $95\geqq$cut rate $Z>5.3\times X$), particles having a circularity a of 0.950 or more preferably satisfy the expression: number-based cumulative value $Y\geqq$exp $5.37\times X^{-0.545}$ as shown in FIG. 2B.

In the present invention, the cut rate Z is expressed as the above Expression (3) when the concentration of all particles measured by the flow-type particle image analyzer FPIA-10 manufactured by TOH MEDICAL ELECTRONICS CO., LTD. is defined as A (the number of particles/μl) and the concentration of measured particles having a circle-equivalent diameter of 3 μm or more is defined as B (the number of particles/μl). The toner weight average particle diameter X is between 5.0 and 12.0 μm.

Such a circularity provides toner for which charging can be easily controlled and made uniform and stable over a long time. Furthermore, it has been found that the above-described circularity raises the developing efficiency. The reason is assumed to be that the toner having the above-described circularity has a small contact area between the toner particles and the photosensitive member to reduce the adhesion of the toner to the photosensitive member in connection with the van der Waals force. Moreover, as compared with toner particles obtained by crushing a material using a conventional collision stream crusher, the specific surface area of the toner particles decreases, the contact area between the particles is reduced, and the bulk density increases, so that heat transfer during fixing is raised to improve the fixing capability.

Furthermore, if particles have a circle-equivalent diameter of 3 μm or more including less than 90%, in terms of the number-based cumulative value, of particles having a circularity a of 0.900 or more, the contact area between the toner and the photosensitive member becomes larger to increase the adhesion of the toner to the photosensitive member, thereby making it difficult to obtain a sufficient developing efficiency. FIG. 2A and FIG. 2B show the relationship with conventional toner (shown by white circles) as measured according to the present invention.

With toner particles having a circle-equivalent diameter of 3 μm or more, if (i) the relationship between the cut rate Z and the toner weight-average particle diameter satisfies the expression:

cut rate $Z\leqq 5.3\times X$ (preferably $0<$cut rate $Z\leqq 5.3\times X$) but does not satisfy the expression:

number-based cumulative value $Y\geqq$exp $5.51\times X^{-0.645}$ (where the number-based cumulative value Y<exp $5.51\times X^{-0.645}$), or if (ii) the relationship between the cut rate Z and the toner weight-average particle diameter satisfies the expression: cut rate $Z>5.3\times X$ (preferably $95\geqq$cut rate $Z>5.3\times X$) but does not satisfy the expression: number-based cumulative value $Y\geqq\exp 5.37\times X^{-0.545}$ (where the number-based cumulative value $Y<\exp 5.37\times X^{-0.545}$), then a sufficient developing efficiency is not obtained, the fluidity of the toner is liable to decrease, and the desired fixing capability tends to be hard to obtain.

To produce toner having a specific circularity, the toner preferably has a weight-average particle diameter of 5 to 12 μm. More preferably, the toner has a weight-average particle diameter of 5 to 10 μm and 40% or less of the number of particles of the toner have a particle diameter of 4.0 μm or less and 25% (% by volume) or less of the volume of the particles of the toner have a particle diameter of 10.1 μm or more.

If a toner having a weight average particle diameter of more than 12 μm is to be obtained, such a particle diameter can be achieved by minimizing the load on the toner inside the crusher or increasing the throughput. However, the particles obtained may be angular, so that it is difficult to achieve the desired circularity and thus, the desired circularity distribution. Further, if toner having a weight-average particle diameter of less than 5 μm is to be obtained, such a particle diameter can be achieved by increasing the load on the toner inside the crusher or extremely reducing the throughput. However, the shape of the particles obtained may be close to a sphere, so that it is difficult to achieve the desired circularity and thus the desired circularity distribution. Further, fine or very fine powder is likely to be generated.

If toner is to be obtained containing particles having a circle-equivalent diameter of 4.0 μm or less that comprise more than 40% of the total number of particles, this goal can be achieved by increasing the load on the toner inside the crusher or extremely reducing the throughput. However, the shape of particles obtained may be close to a sphere, so that it is difficult to achieve the desired circularity and thus, the desired circularity distribution. If toner is to be obtained containing particles having a circle-equivalent diameter of 10.1 μm or less that comprise more than 25% of the total number of particles, this goal can be achieved by minimizing the load on the toner inside the crusher or increasing the throughput. The particles obtained may be angular, so that it is difficult to achieve the desired circularity and thus, the desired circularity distribution.

The weight-average particle diameter and particle distribution of the toner according to the present invention can be measured using a Coulter Counter TA-II or a Coulter Multi-sizer (both are manufactured by Coulter Co., Ltd.). In the present invention, using a Coulter Multi-sizer (manufactured by Coulter Co., Ltd.) to which an interface (manufactured by Nikkaki Co., Ltd.) and a PC9801 personal computer (manufactured by NEC Co., Ltd.) are connected, the number and volume distributions are determined. As an electrolyte, a 1% NaCl solution is prepared using first-class sodium chloride. For example, the electrolyte may be ISOTON R-II (manufactured by Coulter Scientific Japan Co., Ltd.).

The measuring method comprises adding a surfactant (preferably alkyl benzene sulfonate) to 100 to 150 ml of the electrolyte as a dispersant and further adding 2 to 20 mg of a sample to be measured to the mixture. The electrolyte with the sample suspended therein is dispersed by an ultrasonic dispersing apparatus for about one to three minutes, and then the previously described Coulter Multi-sizer with a 100 μm aperture is used to measure the volume of the toner and the number of particles therein and calculate volume and number distributions.

Then, a particle-diameter distribution can be determined on the basis of a volume-based weight-average particle diameter (D4) determined from the volume distribution, a particle-diameter distribution and a volume-average particle diameter (DV), and the number distribution.

If the toner is magnetic, magnetic materials contained in the magnetic toner may include iron oxides such as magnetite, maghemite, ferrite, and iron oxides containing other metal oxides; and metals such as Fe, Co, and Ni, and alloys of such metal and Al, Co, Cu, Pb, Mg, Ni, Sn, Zn, Sb, Be, Bi, Cd, Ca, Mn, Se, Ti, W, or V, and mixtures thereof.

Specifically, the magnetic materials may include triiron tetraoxide ($Fe_3O_4$), iron sesquioxide ($\gamma$-$Fe_2O_3$), iron oxide zinc ($ZnFe_2O_4$), iron oxide yttrium ($Y_3Fe_5O_{12}$), iron oxide cadmium ($CdFe_2O_4$), iron oxide gadolinium ($Gd_3Fe_5O_{12}$), iron oxide copper ($CuFe_2O_4$), iron oxide lead ($PbFe_{12}O_{19}$), iron oxide nickel ($NiFe_2O_4$), iron oxide neodymium ($NdFe_2O_3$), iron oxide barium ($BaFe_{12}O_{19}$), iron oxide magnesium ($MgGe_2O_4$), iron oxide manganese ($MnFe_2O_4$), iron oxide lanthanum ($LaFeO_3$), iron powders (Fe), cobalt powders (Co), and nickel powders (Ni). One or more of the magnetic materials listed above may be combined together. Particularly preferable magnetic materials are fine powders of triiron tetraoxide or iron sesquioxide.

These magnetic materials preferably have a number-average particle diameter of 0.05 to 2 μm and have the following magnetic characteristics when subjected to 795.8 kA/m: a coercive force of 1.6 to 12.0 kA/m, a saturation magnetization of 50 to 200 $Am^2/kg$ (preferably 50 to 100 $Am^2/kg$), and a residual magnetization of 2 to 20 $Am^2/kg$.

The magnetic toner preferably contains 10 to 200 parts by weight and preferably 20 to 150 parts by weight of magnetic material based on 100 parts by weight of binding resin.

When the toner is produced by a specific production method using specific components, the circularity of toner particles of 3 μm or more size can be controlled within the range according to the present invention.

The magnetic toner components include at least a binding resin and a magnetic material. The magnetic material is as described above.

The binding resin may include a vinyl-based resin, a polyester-based resin, or an epoxy-based resin.

Ingredients usually used for toner, such as a releasing agent, a plasticizer, a charge-control agent, a cross-linking agent, and optionally a coloring material and other additives, may be appropriately added to the toner.

A fluidity-improving agent may be added to the toner. When the fluidity-improving agent is added to the toner particles, their fluidity can be improved. For example, the fluidity-improving agent may include fluorine resin powder such as fine powders of vinylidene fluoride or polytetrafluoroethylene; or fine powders of silica such as wet-process silica or dry-process silica, fine powder of titanium oxide or alumina, or processed silica obtained by having fine powder of titanium oxide or alumina surface-treated with a silane compound, a titanium coupling agent, or silicone oil. Other additives may include oxides such as zinc oxide and tin oxide; double oxides such as strontium titanate, barium titanate, calcium titanate, strontium zirconate and calcium zirconate; and carbonate compounds such as calcium carbonate and magnesium carbonate.

The developer used in the present invention may also be a two-component developer having the toner and holding-member particles. The holding-member particles may include a magnetic metal, such as surface-oxidized or non-oxidized iron, nickel, copper, zinc, cobalt, manganese, chromium, and rare earth metal, and alloys and oxides thereof; ferrite, and resin holding members with magnetic powders dispersed therein.

Figure 10:
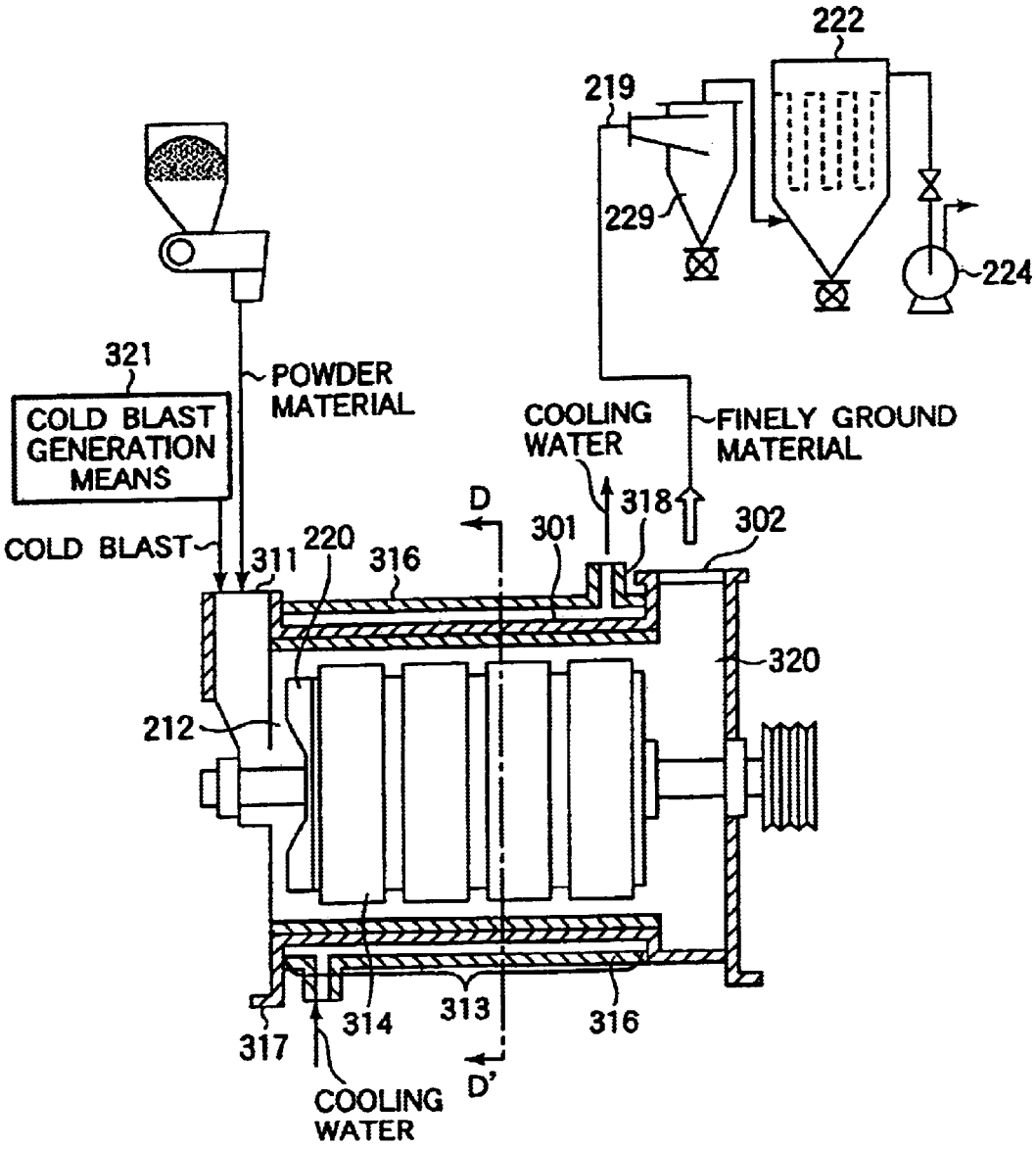
FIG. 10 is a schematic sectional view of an example of a mechanical crusher used in a toner-crushing step according to the present invention.
Figure 11:
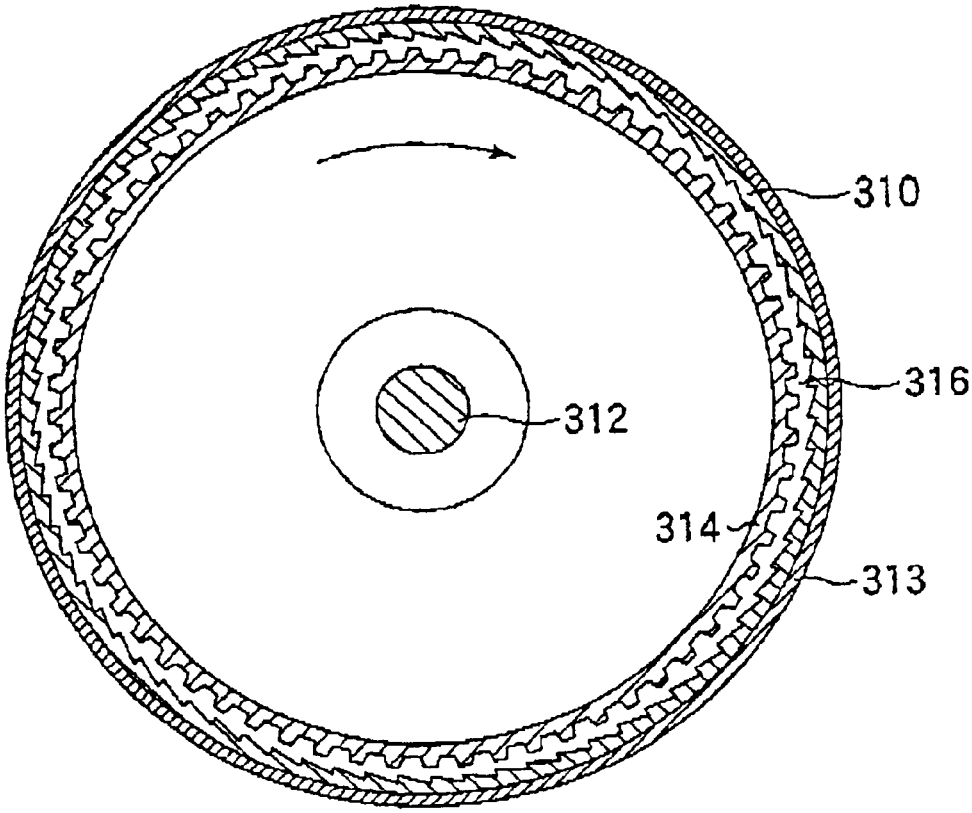
FIG. 11 is a schematic sectional view taken along line D–D' of FIG. 10.
Figure 12:
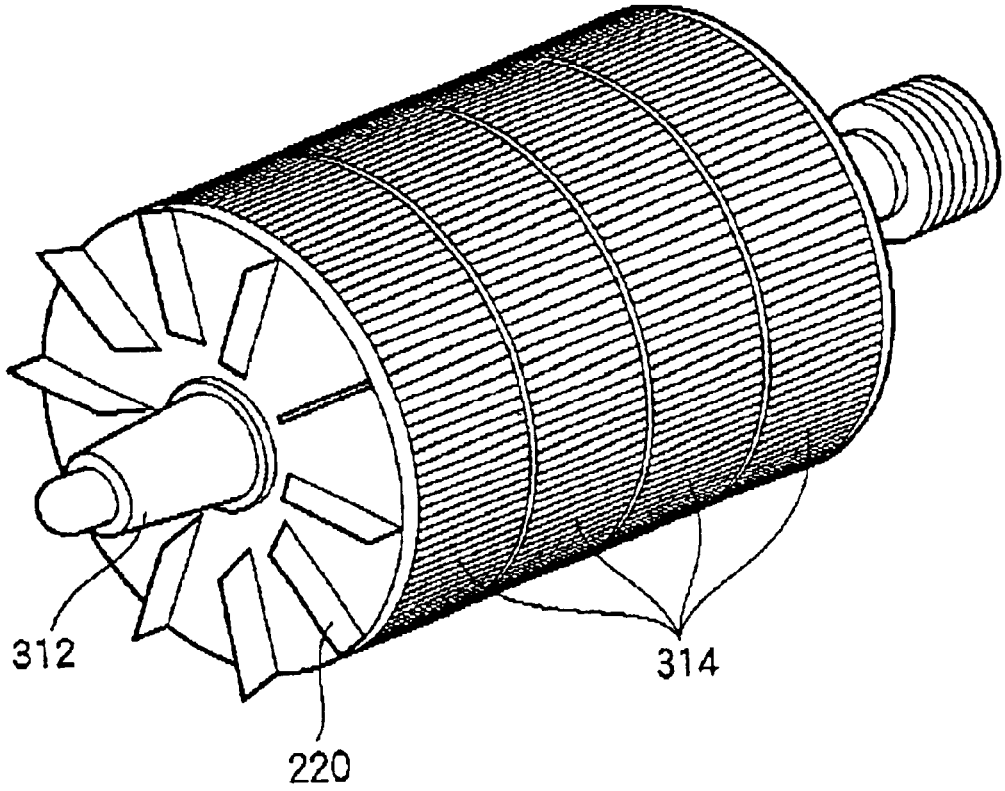
FIG. 12 is a perspective view of the rotor shown in FIG. 10.

The toner used in the present invention can be manufactured by using a mechanical crusher such as the one shown in FIGS. 10, 11, and 12 to crush a power material.

The mechanical crusher shown in FIGS. 10, 11, and 12 will be described below. FIG. 10 is a schematic sectional view showing an example of a mechanism crusher. FIG. 11 is a schematic sectional view taken along line D–D' in FIG. 10. FIG. 12 is a perspective view of a rotor 314, shown in FIG. 10. As shown in FIG. 10, the apparatus is composed of a casing 313, a jacket 316, a distributor 220, the rotor 314 located in the casing 313, mounted on a central rotating shaft 312, and having a large number of grooves formed on the surface thereof rotating at a high speed, a stator 310 having a large number of grooves formed on the surface thereof arranged over the outer circumference of the rotor 314 at given intervals, a material-loading port 311 through which a material to be processed is introduced, and a material-discharge port 302 through which processed powder is discharged.

A mechanical crusher constructed as above will be described, for example, as follows:

When a predetermined amount of powder material is loaded through the material-loading port 311 of the mechanical crusher shown in FIG. 10, the particles are introduced into a crushing-process chamber and then instantaneously crushed as a result of the impact between the rotor 314, having the large number of grooves formed on the surface thereof rotating at a high speed in the crushing-process chamber, and the stator 310, having the large number of grooves formed therein, as well as a large number of very fast whirl currents occurring behind the impact and the associated high-frequency pressure vibration. Subsequently, the crushed pieces are discharged through the material-discharge port 302. Air carrying the toner particles passes through the crushing-process chamber, the material-discharge port, 302, a pipe 219, a collecting cyclone 229, a bug filter 222, and a suction filter 224, and is then discharged from the apparatus system. In the present invention, the powder material is crushed in the above manner, so that the desired crushing-process can be easily achieved without increasing the amount of fine or coarse powder.

Further, when the mechanical crusher crushes the material, a cold-blast generating means 321 is preferably used to blow cold air into the mechanical crusher simultaneously with the introduction of the powder material. The cold air preferably has a temperature of 0 to −18° C. Furthermore, the mechanical crusher preferably has a jacket structure 316 as an internal cooling means to allow a coolant (preferably an anti-freezing solution such as ethylene glycol) to flow through the machine. Moreover, the above-mentioned cold-blast device and jacket structure preferably keep the room temperature T1 in a whirl-current chamber 212 that is in communication with the material-loading port in the mechanical crusher, at 0° C. or lower, more preferably between −5 and −15° C., or much more preferably between −7 and −12° C. in order to improve toner productivity. By keeping the room temperature of the whirl-current chamber in the crusher at 0° C. or lower, more preferably between −5 and −15° C., and much more preferably between −7 and −12° C., the surface of the toner can be prevented from being thermally modified, thereby allowing the material to be efficiently crushed. If the room temperature T1 of the whirl-current chamber in the crusher exceeds 0° C., it is subject to occur that the toner is thermally modified in its surface or fused in the machine. This is not preferable from the toner-productivity viewpoint. On the other hand, to operate the crusher with the temperature of the whirl-current chamber kept lower than −15° C., the refrigerant (alternative Freon) used in the cold-blast generating means 321 must be changed to Freon.

A coolant (preferably an anti-freezing solution) is supplied to the interior of the jacket through a coolant-supply port 317 and is discharged through a coolant-discharge port 318.

Crushed material produced in the mechanical crusher passes through a rear chamber 320 and is then discharged from the crusher through the material-discharge port 302. In this case, the room temperature T2 of the rear chamber 320 of the mechanical crusher is preferably kept between 30 and 60° C. in order to improve toner productivity. By keeping the room temperature of the rear chamber 320 of the mechanical crusher between 30 and 60° C., the surface of the toner can be prevented from being thermally modified, thereby allowing the material to be efficiently crushed. If the temperature T2 of the mechanical crusher is lower than 30° C., the material may not have been crushed and a short path may have been caused. This is not preferable in terms of toner productivity. On the other hand, if the temperature T2 is higher than 60° C., the material may have been excessively crushed during the crushing operation. It is subject to occur that the toner is thermally modified in its surface or fused inside the machine Again, this is not preferable in terms of toner productivity.

When the mechanical crusher crushes the material, the difference ΔT (T2−T1) between the room temperature T1 of the whirl-current chamber 212 of the mechanical crusher and the room temperature T2 of the rear chamber 320 is preferably kept between 40 and 70° C., more preferably between 42 and 67° C., and much more preferably between 45 and 65° C. in order to improve toner productivity. By keeping the difference ΔT between the temperatures T1 and T2 of the mechanical crusher, between 40 and 70° C., more preferably between 42 and 67° C., and much more preferably between 45 and 65° C., the surface of the toner can be prevented from being thermally modified, thereby allowing the material to be efficiently crushed. If the difference ΔT between the temperatures T1 and T2 of the mechanical crusher is smaller than 40° C., the material may not have been crushed and a short path may have been caused. This is not preferable in terms of toner productivity. On the other hand, if the difference ΔT is larger than 70° C., the material may have been excessively crushed during the crushing operation. It is subject to occur that the surface of the toner is thermally modified or the toner is fused inside the machine. Again, this is not preferable in terms of toner productivity.

Further, when the mechanical crusher crushes the material, the glass transition point (Tg) of the binding resin is preferably between 45 and 75° C. and more preferably between 55 and 65° C. Furthermore, the room temperature T1 of the whirl-current chamber 212 of the mechanical crusher is preferably kept 0° C. or lower and 60 to 70° C. lower than the glass-transition point Tg in order to improve toner productivity. By keeping the room temperature T1 of the whirl-current chamber 212 of the mechanical crusher 0° C. or lower and 60 to 70° C. lower than the glass-transition point Tg, the surface of the toner can be prevented from being thermally modified, thereby allowing the material to be efficiently crushed. Moreover, the room temperature T2 of the rear chamber 320 of the mechanical crusher is preferably kept 5 to 30° C. and more preferably 10 to 20° C. lower than the glass-transition point Tg. By keeping the room temperature T2 of the rear chamber 320 of the mechanical crusher 5 to 30° C. and more preferably 10 to 20° C. lower than the glass-transition point Tg, the surface of the toner can be prevented from being thermally modified, thereby allowing the material to be efficiently crushed.

The peripheral speed of the tip of the rotating rotor 314 is preferably kept between 80 and 180 m/sec., more preferably between 90 and 170 m/sec., and much more preferably between 100 and 160 m/sec. in order to improve toner productivity. By keeping the peripheral speed of the tip of the rotating rotor 314 between 80 and 180 m/sec., more preferably between 90 and 170 m/sec., and much more preferably between 100 and 160 m/sec., the toner can be prevented from being insufficiently or excessively crushed, thereby allowing the powder material to be efficiently crushed. If the peripheral speed of the rotor is lower than 80 m/sec., the material may not be crushed but a short path is prone to be created. This is not preferable in terms of toner productivity. On the other hand, if the peripheral speed of the rotor 314 is higher than 180 m/sec., the apparatus may be subjected to a larger load, while the material may be excessively crushed during the crushing operation. It is subject to occur that the surface of the toner is thermally modified or the toner is fused inside the machine. Again, this is not preferable in terms of toner productivity.

The minimum interval between the rotor 314 and the stator 310 is preferably set between 0.5 and 10.0 mm, more preferably between 1.0 and 5.0 mm, and much more preferably between 1.0 and 3.0 mm. By setting the minimum interval between the rotor 314 and the stator 310, between 0.5 and 10.0 mm, more preferably between 1.0 and 5.0 mm, and much more preferably between 1.0 and 3.0 mm, the toner can be prevented from being insufficiently or excessively crushed, thereby allowing the powder material to be efficiently crushed. If the interval between the rotor 314 and the stator 310 is larger than 10.0 mm, the material may not be crushed and a short path is prone to be caused. This is not preferable in terms of toner productivity. On the other hand, if the interval between the rotor 314 and the stator 310 is smaller than 0.5 mm, the apparatus may be subjected to a larger load, while the material may be excessively crushed during the crushing operation. It is subject to occur that the surface of the toner is thermally modified or the toner is fused inside the machine. Again, this is not preferable in terms of toner productivity.

Next, an air classifier is described which is preferably used as a classifying means for classifying finely crushed product obtained by using the mechanical crusher to crush the above-described material, and adjusting the particle-diameter distribution of the toner, in order to produce the toner used in the present invention.

Figure 13:
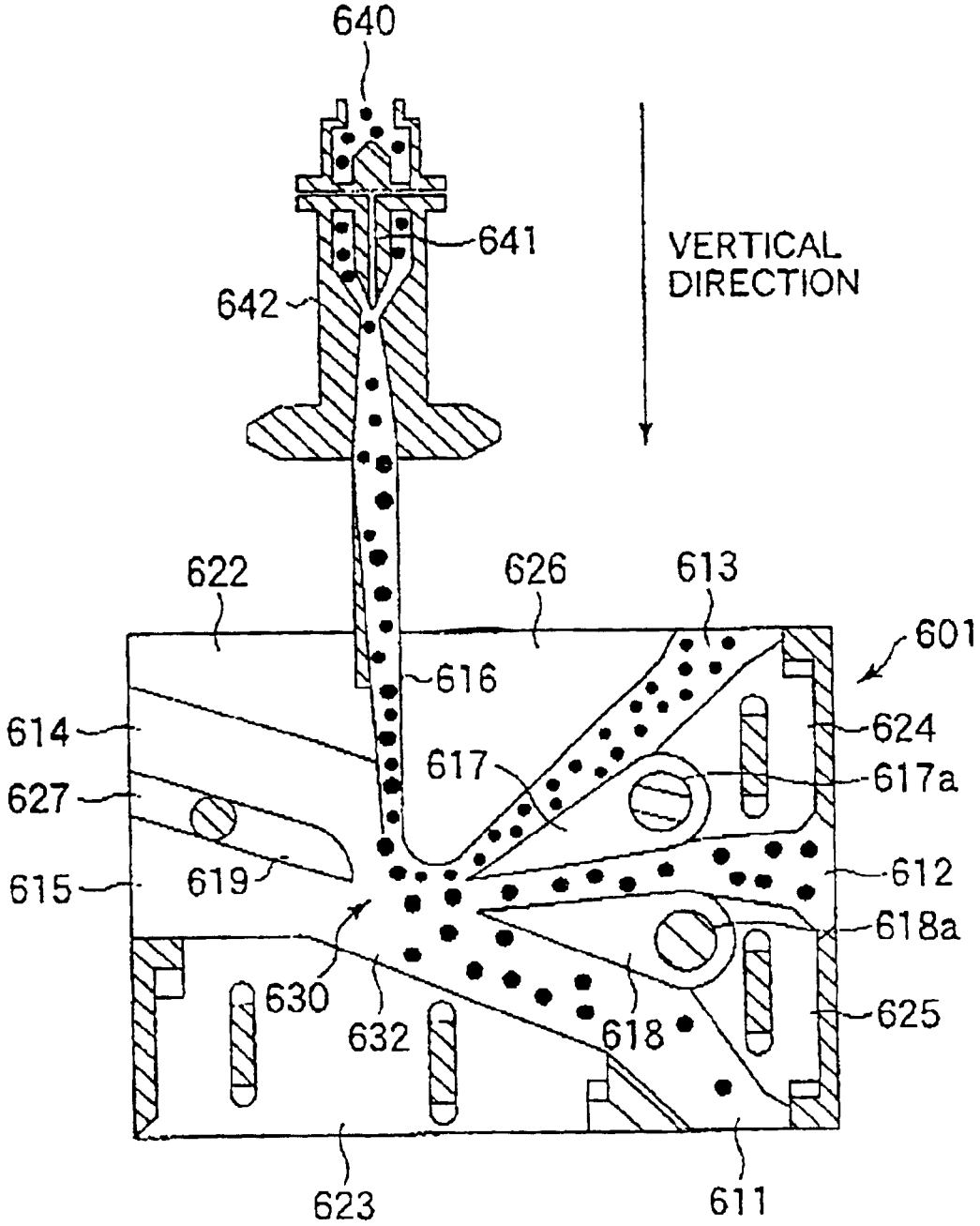
FIG. 13 is a schematic sectional view of a multi-division air classifier used in a toner classifying step according to the present invention.

An apparatus of the form shown in FIG. 13 (sectional view) will be illustrated as an example of a multi-division air classifier preferably used in the present invention.

In FIG. 13, a side wall 622 and a G block 623 form part of a classifying chamber, and classifying-edge blocks 624 and 625 are provided with classifying edges 617 and 618. The G block 623 allows its installed position to slide in the lateral direction. Further, the knife-edge shaped classifying edges 617 and 618 can be rotated around shafts 617*a* and 618*a* in order to change the positions of the tips thereof. The classifying-edge blocks 624 and 625 allow their installed positions to slide in the lateral direction, thereby allowing the knife-edge-shaped classifying edges 617 and 618 to correspondingly slide in the lateral direction. The classifying edges 617 and 618 divide a classifying region 630 in the classifying chamber 623 into three portions.

A material supply port 640 through which material powder is introduced is formed at the rearmost end of a material-supply nozzle 616. A high-pressure supply nozzle 641 and a material-powder introducing nozzle 642 are formed at the rear end of the material-supply nozzle 616. The material supply nozzle 616, having an opening in the classifying chamber 632 is formed to the right of the side wall 622. A Coanda block 626 is installed so as to draw an oblong arc relative to an extension of the lower tangent of the material supply nozzle 616. A left-hand block 627 in the classifying chamber 632 is provided with a knife-edge-shaped air-intake edge 619 in the right of the classifying chamber 632. Furthermore, air-intake pipes 614 and 615 that are opened into the classifying chamber 632 are provided in the left of the classifying chamber 632.

The positions of the classifying edges 617 and 618, the G block 623, and the air-intake edge 619 are adjusted depending on the type of the toner, that is, the material to classify, and the desired particle diameter.

The classifying chamber 632 has discharge ports 611, 612, and 613 opened into the classifying chamber so as to correspond to the respective multi-division regions. The discharge ports 611, 612, and 613 have communication means, such as pipes, connected thereto and may be provided with opening and closing means, such as valve means.

The material-supply nozzle 616 consists of a right-angled cylindrical portion and a pyramidal cylindrical portion. A good introduction speed is achieved by setting the ratio of the inner diameter of the right-angled cylindrical portion to the inner diameter of the narrowest portion of the pyramidal cylindrical portion at 20:1 to 1:1 and preferably 10:1 to 2:1.

A classifying operation is performed in multiple classifying regions constructed as described above. The classifying chamber is subjected to a pressure reduction via at least one of the discharge ports 611, 612, and 613. Powders are injected into the classifying chamber via the material-supply nozzle 616 preferably at a flow velocity of 10 to 350 m/sec and dispersed therein, due to the ejector effect generated by an air current flowing, as a result of the pressure reduction, through the material-supply nozzle 616 having the opening in the classifying chamber, and compressed air injected from the high-pressure air-supply nozzle 641.

Particles in the powders introduced into the classifying chamber move while drawing a curve due to the Coanda effect of the Coanda block 626 and the effect of gas such as air which flows into the chamber. Depending on the particle diameter and inertia force of each particle, large (coarse) particles are carried into a first partition located outside the air current, that is, outside the classifying edge 618, medium particles are carried into a second partition located between the classifying edges 618 and 617, and small particles are carried into a third partition inside the classifying edge 617. The classified large particles are discharged through the discharge port 611, the classified medium particles are discharged through the discharge port 612, and the classified small particles are discharged through the discharge port 613.

In the classification of the powders, classifying points are essentially determined by the positions of the tips of the classifying edges 617 and 618 with respect to the lower end of the Coanda block 626, that is, the location at which the powders gush into the classifying chamber 632. Furthermore, the classifying points are affected by the amount of sucked flow of the classifying air current, the speed at which powders gush through the material-supply nozzle 616, or the like.

In a multi-division air classifier of the type shown in FIG. 13, the material-supply nozzle, the material-powder introducing nozzle, and the high-pressure air-supply nozzle are formed in the top surface thereof, and the classifying edge blocks, comprising the classifying edges, can have their positions changed in order to change the shapes of the classifying regions. Consequently, this classifier achieves a significantly higher classifying accuracy than conventional air-classifying apparatus.

As described above, the toner manufacturing method and system can control the crushing and classifying conditions to efficiently produce toner having a sharp particle-size distribution with a weight-average particle diameter of 12 μm or less (in particular 8 μm or less) and having a specific circularity and a specific number-based cumulative value.

<2> Image Forming Apparatus and Process Cartridge according to the Invention

An embodiment of an image forming apparatus and a process cartridge according to the present invention will be described in detail with reference to the figures, but the present invention is not limited thereto.

FIG. 1 shows an embodiment of the present invention; it is a sectional view of a process cartridge installed in a laser printer as an image forming apparatus.

Figure 8:
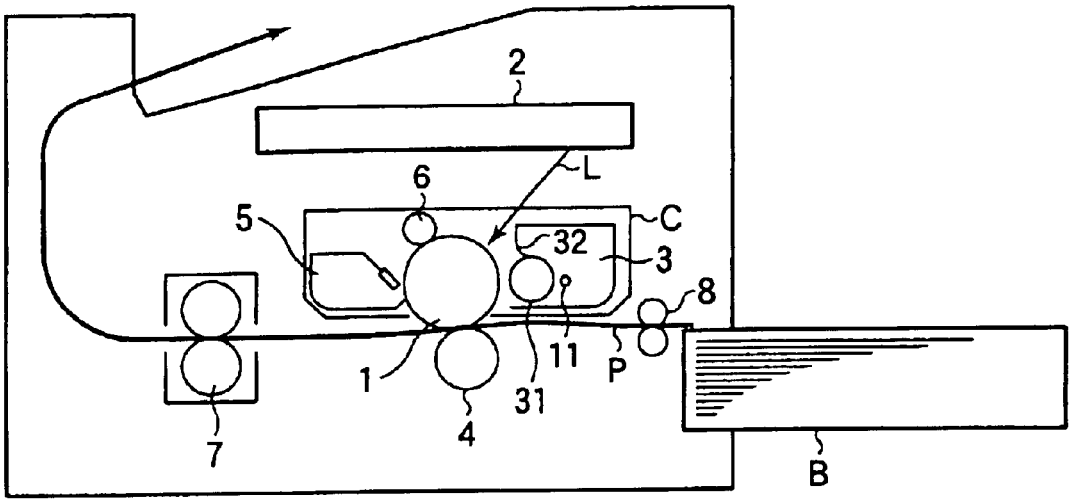
FIG.8 PRIOR ART
FIG. 8 is a sectional view of a conventional image forming apparatus.

The image forming apparatus is generally the same as that shown in FIG. 8, and the description thereof is thus omitted.

In FIG. 1, a photosensitive drum 1 is rotated in the direction of an arrow A by a drive means (not shown) in the image forming apparatus main body. The photosensitive drum 1 has its surface uniformly charged by a charging member 6 such as a contact-charging roller and is then irradiated with light by an exposure device 2 corresponding to an image, thereby forming a static latent image. A developing device 3 comprises magnetic one-component toner T as a developer, a rotatable developing sleeve 31 set opposite to the photosensitive drum 1 so as not to have contact therewith and forming a developing section, a developing blade 32 that regulates the thickness of a toner layer on the developing sleeve 31, and an agitating means 34 for uniformly providing the toner T onto the developing sleeve 31. The toner T is held on the developing sleeve 31 by the force of a magnet fixed and disposed in the developing sleeve 31, and has a predetermined amount of charges as a result of the friction between the toner and the rotating developing sleeve 31 or the developing blade 32. In this embodiment, the developing blade 32 is composed of urethane rubber of 1.2 mm thickness, and abuts against the developing sleeve 31, having Ra=1.5 μm, at a pressure of 0.2 N/cm per unit length to form a toner layer of 1.5 mg/cm$^2$. Here, the toner T has been produced according to the present invention.

In the present invention, it is sufficient for the developing blade 32 to be composed of elastic material, such as urethane rubber or silicon rubber. As shown in FIG. 1, the free end side of the developing blade 32 preferably surface abuts against the developing sleeve 31 on the upstream side thereof relative to the developing section in the direction in which the developing sleeve 31 rotates. In the above description, the developing sleeve 31 abuts against the developing sleeve at a pressure of 0.2 N/cm per unit length, but the present invention is not limited to this pressure.

A potential difference is produced between the developing sleeve 31 and a static latent image on the photosensitive drum 1 (the developing section) by AC and DC voltages supplied to the developing sleeve 31 by a developing bias power supply or source 14. The toner T is thus transferred from the developing sleeve 31 to latent images on the photosensitive drum 1, located at an interval of 300 μm from the developing sleeve 31. The dark potential Vd at the photosensitive drum is assumed to be −650 V, and the light potential Vl at the photosensitive drum is assumed to be −200 V. The developing AC voltage has a rectangular wave, an output value Vpp=1,600 V, a frequency of 2,000 Hz, and a duty cycle of 50%. A manifest image on the photosensitive drum, having the toner thereon, is transferred to a sheet P, such as recording paper, by a transfer means 4. The remaining toner on the photosensitive drum is accumulated in a cleaning device 5.

The photosensitive drum 1, the developing device 3, and at least one of the cleaning device 5, a charging roller 6, and other elements integrally constitute a process cartridge C. The image forming apparatus consists of these means, an exposure means 2, charging-bias power sources 13 and 14, a transfer member such as the transfer roller 4, signal processing means and electric circuits, a fixing device 7 (shown in FIG. 8), and recording-paper conveying system. This process cartridge can be installed in, and removed from, the printer main body using an installing and removing device 40 when, for example, its lifetime has ended.

With the image forming apparatus and process cartridge according to the present invention, the ratio of the peripheral speed of the developer holding member to that of the photosensitive member can be maintained at 1.2 or less:1, by using the specific toner. This is preferred because a high process speed and long lifetime can be realized with this simple construction.

In the developing section, the ratio of the peripheral speed of the developing sleeve to that of the photosensitive member is preferably set at 1.2 or less:1. More preferably, the peripheral speeds of both members are equal. Preferably, setting the ratio at 1.2 or less:1 is preferred to be able to lengthen the lifetime of the developing sleeve. Further, if the ratio can be set at 1:1 (equal speed), this is advantageous to the lifetime of the sliding portion between the developing sleeve and the photosensitive drum.

The ability to set a low peripheral speed for the developing sleeve as described above is advantageous in increasing the lifetime and the process speed of the apparatus and the process cartridge because mechanical stress exerted on the toner by the developing sleeve can be reduced.

The image forming apparatus and process cartridge according to the present invention may not be constituted as shown in FIG. 1; they may be constituted in the same manner as a conventional image forming apparatus, except that the peripheral speed of the electrophotographic photosensitive member is set at 150 mm/sec. or higher, the toner is manufactured according to the present invention, and preferably the ratio of the peripheral speed of the developing sleeve to that of the photosensitive member is set at 1.2 or less:1.

The present invention will be described in further detail with reference to examples, but the present invention is not limited to these examples.

EXAMPLE 1

The results of experiments on differences in developing characteristics between the present toner and conventional toner will be shown below.

<1> Toner Production

As the present toner, toner 1 was produced in the following manner:

[Example of the Production of Coarse Crushed Toner]

Binding resin (styrene-butyl acrylate-butyl maleate half ester copolymer): 100 parts by weight (Tg 64° C., molecular weight: Mp13000, Mn6400, Mw240000)

Magnetic iron oxide: 90 parts by weight (Number average particle diameter: 0.22 μm, characteristics in a 795.8-kA/m magnetic field (coercive force: 5.1 kA/m, saturation magnetization: 85.1 $Am^2/kg$, residual magnetization: 5.1 $Am^2/kg$)

Monoazo metal complex (negative charge control agent): 2 parts by weight

Low-molecular-weight ethylene-propylene copolymer: 3 parts by weight

The materials listed above were mixed together in a HENSHELL mixer (FM-75 type; manufactured by Mitsui Miike Chemical Industrial Machinery Co., Ltd.), and were then kneaded in a two-shaft kneader (PCM-30 type; manufactured by Ikegai Ironworks Co., Ltd.) that was set at 150° C. The kneaded mixture was cooled and then coarsely crushed down to 1 mm or less using a hammer mill to obtain a powder material (coarse crushed pieces) that is used to produce toner.

[Production Example of Toner 1]

The above powder material was subjected to crushing and classifying operations in the following manner: A turbo mill T-250 manufactured by Turbo Industry Co., Ltd. was used as a mechanical crusher and was operated with the interval between the rotor 314 and the stator 310, both shown in FIG. 10, set at 1.5 mm and with the peripheral speed of the rotator 314 set at 115 m/s. At this time, the temperature of cold air (or cold blast) was −15° C., the temperature T1 in the whirl-current chamber in the mechanical crusher was −10° C., the temperature T2 in the rear chamber was 50° C., and the difference ΔT between the temperatures T1 and T2 was 60° C. Further, Tg−T1=74° C., and Tg−T2=14° C. Powder obtained through a crushing operation by the mechanical crusher 301 had a weight-average size of 6.9 μm and a particle-diameter distribution in which 50% of the number of particles of powder were 4.00 μm or less in size and 7% of the volume of the powder comprised paticles of powder of 10.08 μm or more in size.

Then, the powder obtained through a crushing operation by the mechanical crusher was introduced into the air classifier 601 having the constitution as shown in FIG. 13. The air classifier 601 uses the Coanda effect to classify powder into three types of particle diameters: coarse powder, medium powder, and fine powder. To introduce the fine powder into the air classifier 601, the classifying chamber was subjected to a pressure reduction via at least one of the discharge ports 611, 612, and 613, and utilizing an air current flowing, as a result of the pressure reduction, through the material supply nozzle 616, having the opening in the classifying chamber, and compressed air injected from the high-pressure air supply nozzle 641. The introduced powders were instantaneously classified into coarse, medium, and fine powders within 0.1 second.

The medium powder (fraction) obtained through the above classifying step had a weight-average particle diameter of 6.8 μm and a sharp particle-diameter distribution in which 19% of the number of particles were 4.00 μm or less in size and 2% of the volume of particles were 10.08 μm or more in size. The powder exhibited an excellent performance as a fraction for toner.

Then, 1.2 parts by weight of fine powder of hydrophobic silica (BET specific surface area: 300 $m^2/g$) as an external additive was added to 100 parts by weight of the fraction, which is the medium powder obtained using the HENSHELL mixer, to produce toner.

Table 1 shows the particle-diameter distribution of the toner 1 obtained and the circularity distribution thereof measured using the analyzer FPIA-1000.

[Production Example of Comparative Toner 1]

Comparative toner was manufactured in the following manner: A crushing operation and a classifying operation were performed using the above-described powder material. The collision air crusher shown in FIG. 15 was used. Powders obtained through the crushing operation by the collision air crusher had a weight-average particle diameter of 6.3 μm and a sharp particle-diameter distribution in which 60% of the number of particles were 4.00 μm or less in size and 6% of the volume of particles were 10.08 μm or more size.

Figure 15:
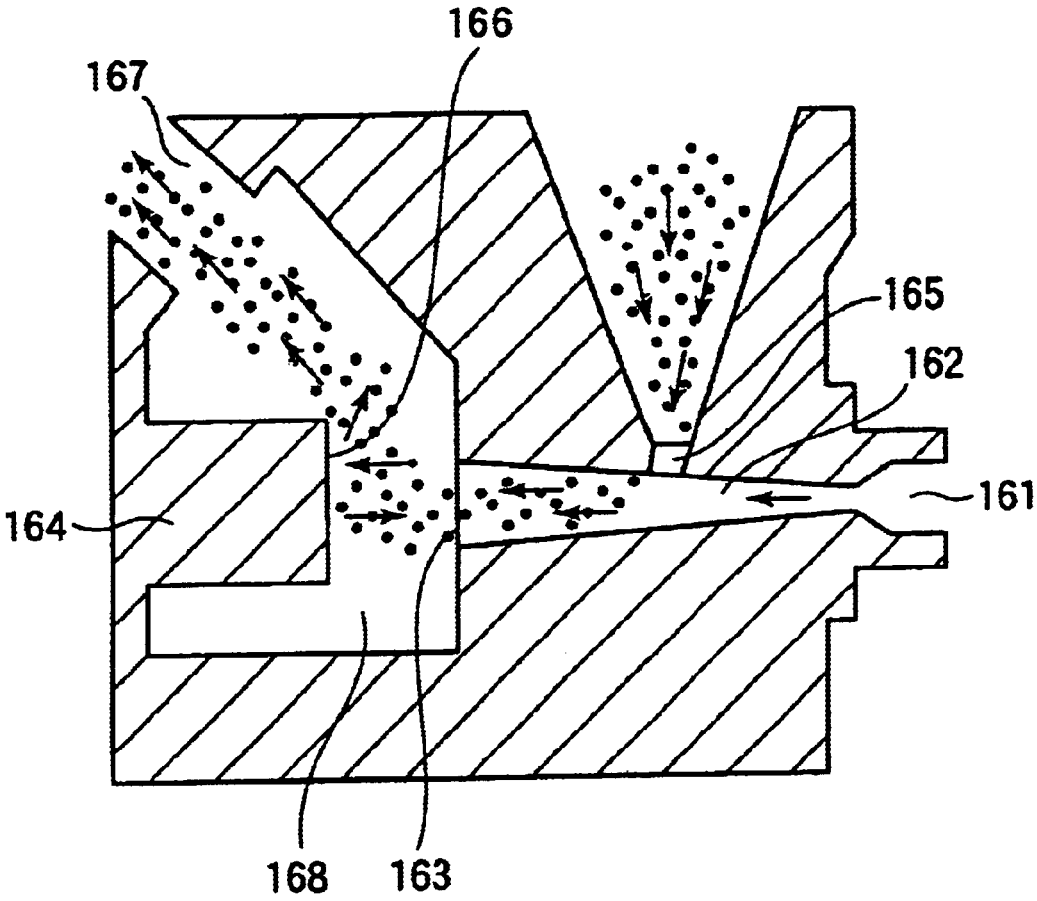
FIG.15 PRIOR ART
FIG. 15 is a schematic sectional view of a conventional collision-stream crusher.

In the collision air crusher shown in FIG. 15, a collision member 164 is provided opposite to the outlet 163 of an acceleration pipe 162 having a high-pressure gas-supply nozzle 161 connected thereto. A high-pressure gas supplied to the acceleration pipe 162 is used to suck a powder material into the acceleration pipe 162 though a powder-material supply port 165 that is in communication with the middle of the acceleration pipe 162. The powder material is blown out together with the high-pressure gas and then collides against the collision surface 166 of the collision member 164. The powder material is crushed as a result of the impact of the collision, and the powder obtained by the collision is discharged from a crushing chamber 168 through a crushed-material discharge port 167.

Figure 14:
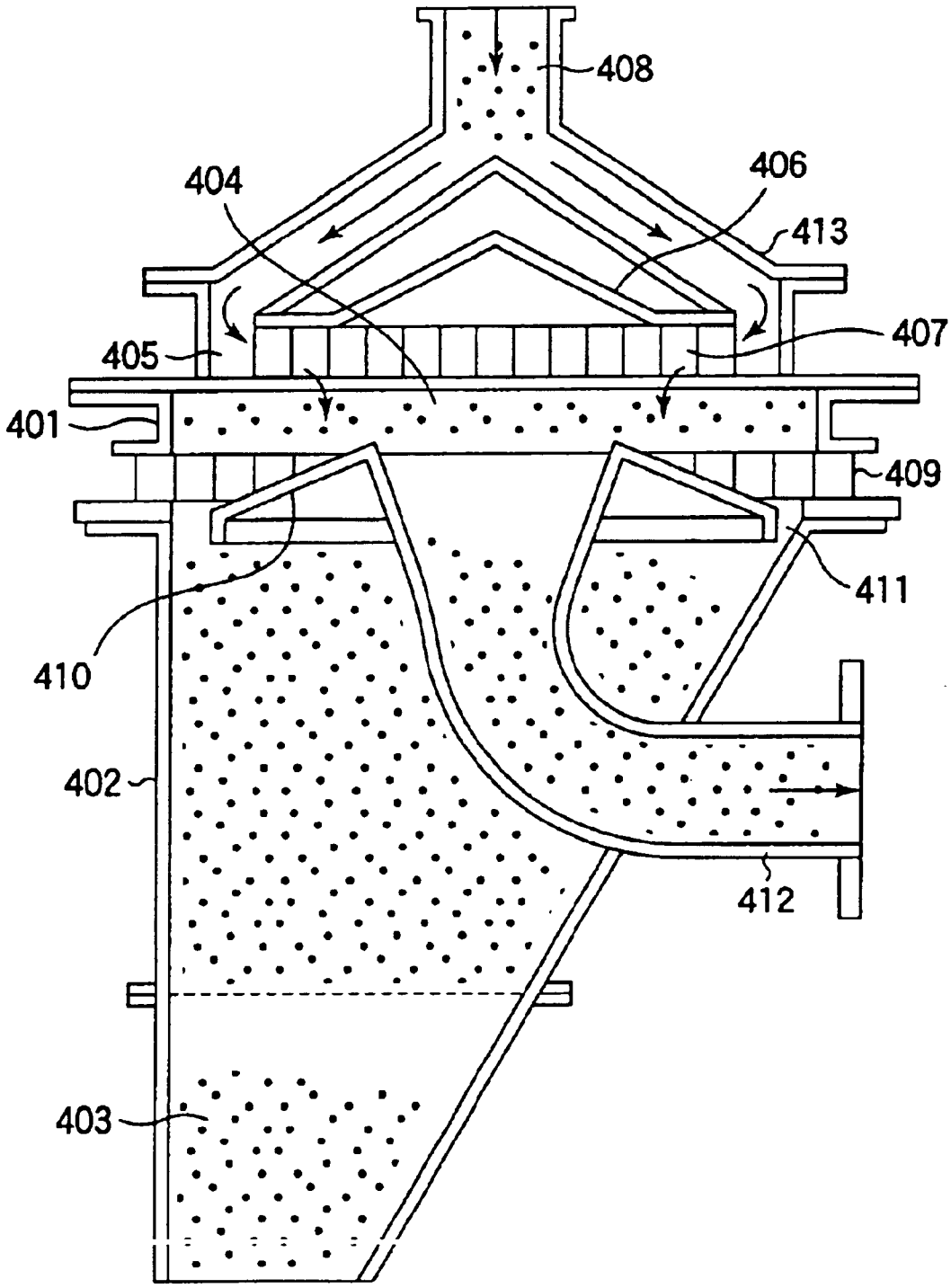
FIG.14 PRIOR ART
FIG. 14 is a view showing a classifying apparatus system for implementing a conventional toner manufacturing method.

During a classifying step, a combination of two air current classifiers constructed as shown in FIG. 14 and which can classify powder into large and small particles are used so that the first classifying means classifies the powder into small and coarse powder and the second classifying means classifies the small powder obtained into medium and fine powder. The medium powder is used as a fraction for toner.

In FIG. 14, reference numeral 401 denotes a main-body casing, and reference numeral 402 denotes a lower casing having a hopper 403 connected at the bottom thereof to discharge coarse powder. The main-body casing 401 has a classifying chamber 404 formed inside and blocked by an annular guide chamber 405 mounted on the top of the classifying chamber 404 and by a conic (umbrella-shaped or conical) top or upper cover 406 having a raised central portion.

A plurality of louver chambers 407 arranged in a circumferential direction are provided on the partitioning wall between the classifying chamber 404 and the guide chamber 405 so that a powder material and air fed into the guide chamber 405 are whirled into the classifying chamber 404 through the louvers 407.

The top of the guide chamber 405 consists of the space between a conical upper casing 413 and a conical upper cover 406.

The main-body casing 401 has classifying louvers 409 provided at the bottom thereof and arranged in the circumferential direction so as to admit classifying air, which causes a whirling current, into the classifying chamber 404 via the classifying louvers 409.

The classifying chamber 404 has a conical (umbrella-shaped) classifying plate 410 provided at the bottom thereof and having a raised central portion. The classifying plate 410 has a coarse-powder discharge port 411 formed in the outer periphery thereof. Further, the classifying plate 410 has a fine-powder discharge chute 412 connected to the center thereof and having an L-shaped lower end that is located outside a side wall of the lower casing 402. Furthermore, the chute is connected to a suction fan via a fine-powder collecting means, such as a cyclone or a dust collector. The suction fan applies suction force to the classifying chamber 404 so that suction air flowing into the classifying chamber 404 through the louvers 409 causes a whirling current, which is required for classifying.

The air classifier is constructed as described above. When air containing coarse crushed pieces used to produce toner is supplied to the guide chamber 405 through a supply cylinder 408, the air containing the coarse crushed pieces passes through the guide chamber 405 and then the louvers 407 and whirls into the classifying chamber 404 while being diffused so as to have a uniform concentration.

The coarse crushed pieces flowing into the classifying chamber 404 while being whirled are more vigorously whirled because of a current of sucked air flowing from between the classifying louvers 409 at the bottom of the classifying chamber. The coarse crushed pieces are then centrifugally separated into coarse and fine powders as a result of the centrifugal force acting on the particles. The coarse particles, whirling around the outer periphery of the classifying chamber 404, are discharged through the coarse-power discharge port 411 and then through the lower hopper 403.

The fine powder, moving to a central portion of the lower casing along the upper inclined surface of the classifying plate 410, is discharged through the fine-powder discharge chute 412.

Medium powder (fraction) classified during the above-described classifying step had a weight-average particle diameter of 6.1 μm and a particle-diameter distribution in which 33% of the number of particles have a size of 4.00 μm or less and 1% of the volume of particles has a size of 10.08 μm or more.

Then, 1.2 parts by weight of fine powder of hydrophobic silica (BET specific surface area: 300 $m^2/g$) was externally added to 100 parts by weight of the fraction, that is, the medium powder obtained using a HENSHELL mixer, to produce comparative toner 1.

Table 1 shows the particle-diameter distribution of the comparative toner 1 obtained and a circularity distribution measured using the analyzer FPIA-1000.

TABLE 1

| Toner number | Weight average particle diameter (μm) | Less than 4.00 μm (no. %) | 10.08 μm or more (vol. %) | 0.900 or more (%) | 0.950 or more (%) | Measured particle concentration A (no./μl) | Measured particle concentration B (no./μl) | Cut rate Z |
|---|---|---|---|---|---|---|---|---|
| Toner 1 | 6.8 | 19 | 2 | 95.5 | 73.4 | 14562.2 | 12523.5 | 14.0 |
| Comparative toner 1 | 6.1 | 33 | 1 | 90.1 | 65.2 | 14185.7 | 11589.7 | 18.3 |

<2> Evaluation of the Developing Capability

Figure 4:
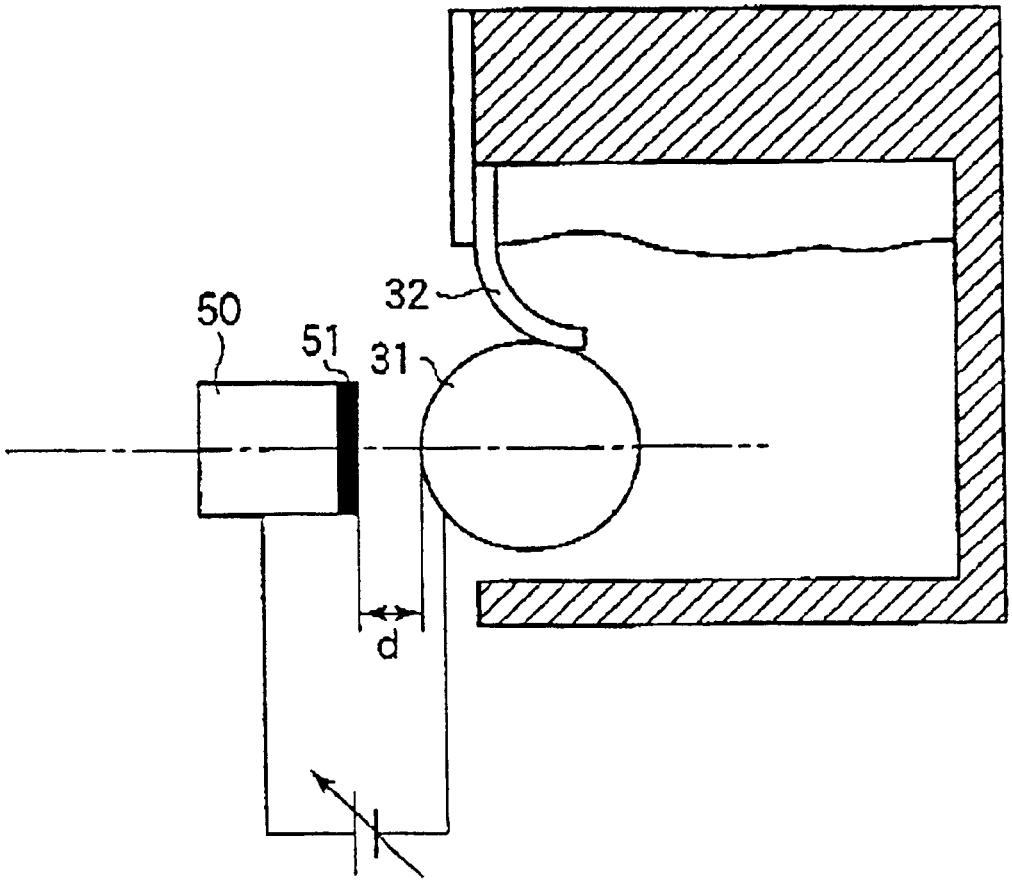
FIG. 4 is a view showing the construction of an apparatus used in a working example for comparison of the developing capability.

To verify that the toner has higher developing capability than the comparative toner, the device shown in FIG. 4 was used to compare these toners for their developing capability. An electrode 50 parallel with the developing sleeve 31 was provided a predetermined distance d (in this embodiment, 0.7 mm) away therefrom so that a DC voltage could be applied between the developing sleeve 31 and the electrode 50. The comparison for the developing capability was executed by blowing the toner coated on the developing sleeve 31 to the electrode 50 and determining the relationship between the applied voltage and the toner adhering to the electrode 50. The fresh toner was charged to a predetermined amount by rotating the developing sleeve 31 twenty times. The electrode 50 was provided with an insulated layer 51 to prevent the charges of the adhering toner from leaking.

The relationship between the applied voltage and the particle distribution of the developed toner was determined for the comparative toner and the toner. When the DC voltages applied between the developing sleeve 31 and the electrode 50 are sequentially increased up to 500, 600, and 700 V, portions of the toner coated on the developing sleeve 31 which can fly off from the sleeve at the respective voltages adhere to the electrode. Strictly speaking, this continuous measurement corresponds to the measurement of the toner collected when the applied voltage V≦500 V, the toner collected when 500 V<the applied voltage V≦600 V, and the toner collected when 600 V<the applied voltage V≦700 V.

Figure 5A:
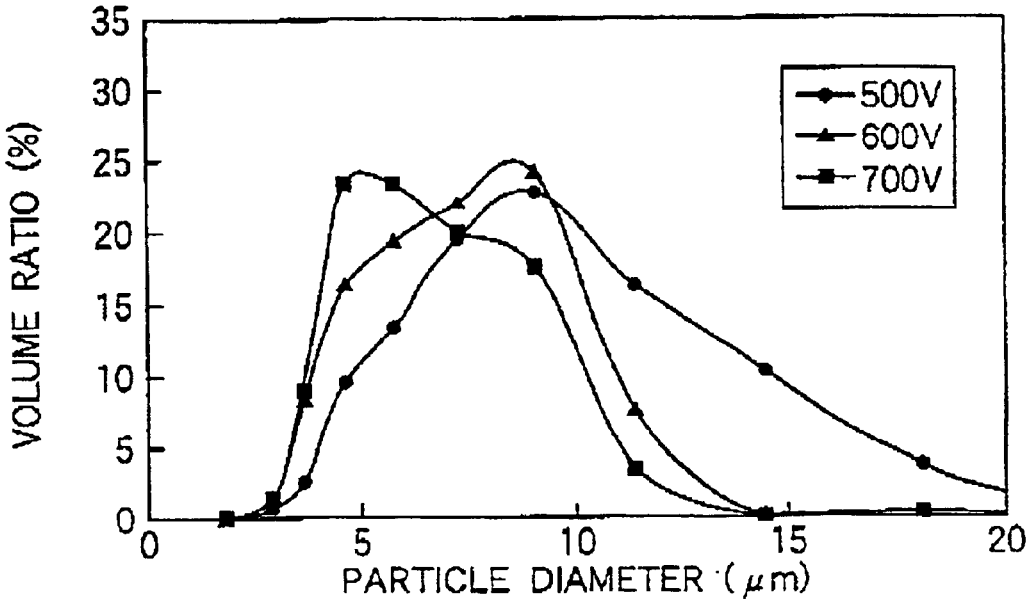
FIGS. 5A and 5B are graphs showing the particle distribution of the toner according to the present invention and a comparative toner in the working example.
Figure 5B:
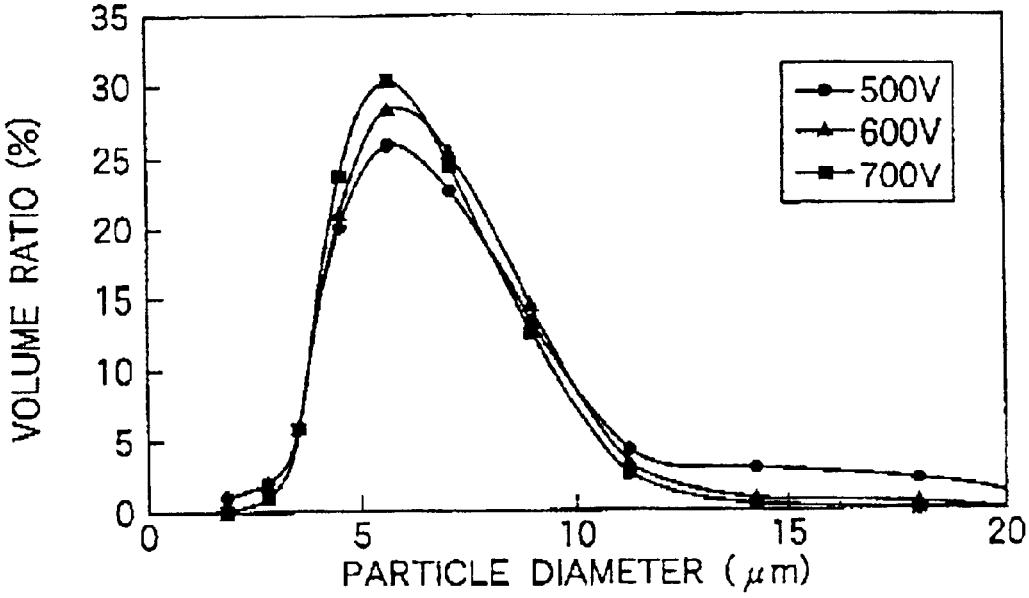

FIGS. 5A and 5B show the particle-diameter distribution of the toner adhering to the electrode at an applied voltage V of 500, 600, and 700 V as measured using a Coulter multi-sizer IIE (manufactured by Coulter Co., Ltd.). The comparative toner, shown in FIG. 5A, exhibits different particle distributions of toner flying at the respective voltages; a larger amount of larger particles fly off at the low voltage, whereas a larger amount of smaller particles fly off at the high voltage. On the other hand, the toner, shown in FIG. 5B, exhibits a particle-diameter distribution that is independent of the voltage.

That is, it has been found that the toner, which meets the conditions of the present invention, has a developing capability that is independent of the particle diameter. Smaller particles of the comparative toner which have a high tribo (tribo: the amount of charges Q held by the toner divided by the weight M of the toner M=Q/M) adhere firmly to the developing sleeve and are not developed (separated from the developing sleeve) unless applying a high voltage thereto. However, even smaller particles of the toner, which meet the conditions of the present invention, adhere loosely to the developing sleeve and are thus easily developed (separated from the developing sleeve).

This is because the toner, having a specific circularity as described above, has a small contact area even though it has a smaller particle diameter than the comparative toner, and thus its adhesion force based on van der Waals force is weaker than that of the comparative toner 1.

Figure 6:
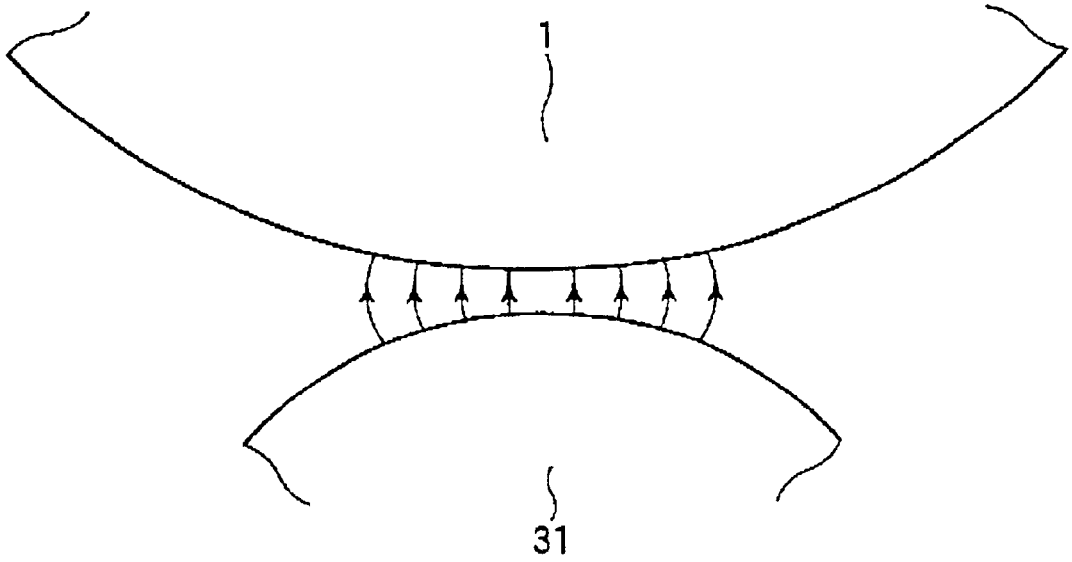
FIG. 6 is a schematic view of a developing section formed by a photosensitive drum and a developing sleeve.

FIG. 6 is a schematic view of the developing section. In the developing section, formed between the photosensitive drum 1 and the developing sleeve 31, electric fields are strong in a portion thereof which has a small interval between the photosensitive drum and the developing sleeve, and are weaker at remoter locations relative to the center thereof. The following is assumed from FIGS. 5A and 5B and FIG. 6: That is, with the comparative toner, a difference between positions of the developing section occurs in relation to the particle size; smaller particles of the toner are mainly used for development near the center of the developing section. In contrast, with the toner according to the present invention, particles can be used for development anywhere in the developing section regardless of their size. Thus, the toner, which meets the conditions of the present invention, has a higher developing efficiency than the comparative toner 1 and is thus suitable for increasing the speed.

Figure 7:
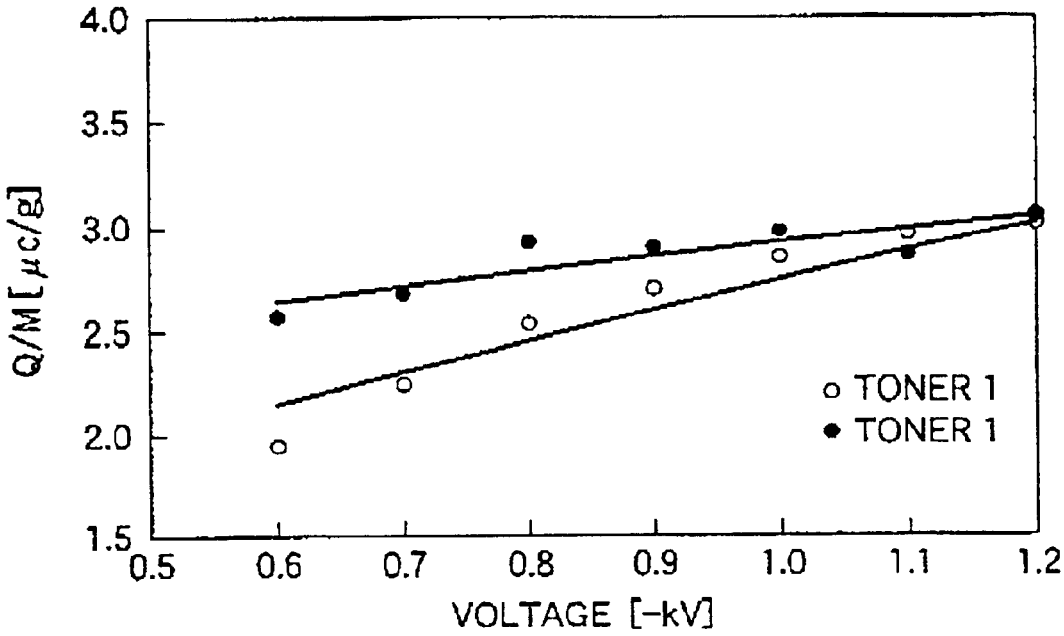
FIG. 7 is a graph showing the relationship between voltages applied to the present toner and the comparative toner and the charge-mass ratio of the toner as developed, in the example.

Further, the difference between the comparative toner and the toner shown in FIG. 7 was confirmed on the basis of the results of the examination of the relationship between the DC voltage applied between the developing sleeve 31 and the electrode 50 and the tribo of the toner. In this examination, the toner was applied under the same conditions (the developing sleeve was rotated 20 times), and the weight and the charge amount of flown toner were measured. The charge amount was measured using a programmable electrometer (manufactured by KEITHLEY Co., Ltd.). The results indicate that the tribo of the toner is proportional to the intensity of the electric fields and that high-tribo particles of the toner are more easily used for development than those of the comparative toner when a low voltage is applied. In general, high-tribo particles of the toner stick more firmly to the developing sleeve. Thus, the toner, obtained by meeting the conditions of the present invention, adheres more loosely to the developing sleeve than the comparative toner, thereby improving developing efficiency.

EXAMPLE 2

In this example, the process cartridge and image forming apparatus constructed as shown in FIG. 1 were used as in the above embodiment and were evaluated for image density.

Specifically, the process cartridge C, comprising the photosensitive drum 1, the developing device 3, and at least one of the cleaning device 5, the charging roller 6, and other means, all these members being integrally supported, is detachably mounted on the image forming apparatus. In addition to these means, the image forming apparatus comprises the exposure means 2, the charging-bias power sources 13 and 14, a transfer member, such as the transfer roller 4, signal processing means and electric circuits, a fixing device, a recording-sheet conveying system, and others.

The developing sleeve 31 and the photosensitive drum 1 are spaced at an interval of 300 $\mu$m. The dark potential Vd at the photosensitive drum 1 is −650 V, and the light potential Vl at the photosensitive drum is −200 V. The developing AC voltage has a rectangular wave, an output value Vpp of 1,600 V, a frequency of 2,000 Hz, and a duty cycle of 50%.

Figure 3:
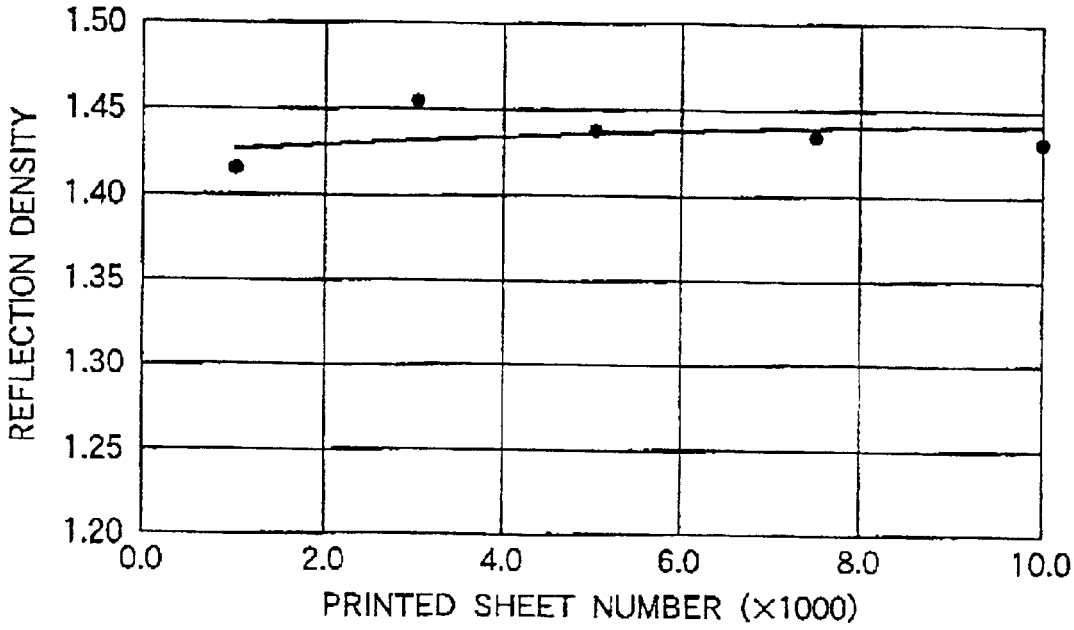
FIG. 3 is a graph showing the relationship between the number of printed sheets and the image-reflection density in the image forming apparatus of the present invention.

FIG. 3 shows the transition of the image-reflection density observed when the toner 1, obtained from Example 1, is used at a process speed (peripheral speed of the photosensitive member) of 200 mm/sec. and when the ratio of the peripheral speed of the developing sleeve 31 to that of the photosensitive drum is set equal to 1:1 (equal speed). In this case, a reflection densitometer X-Rite504 (manufactured by X-Rite Co., Ltd.) was used to measure the image density.

Figure 9:
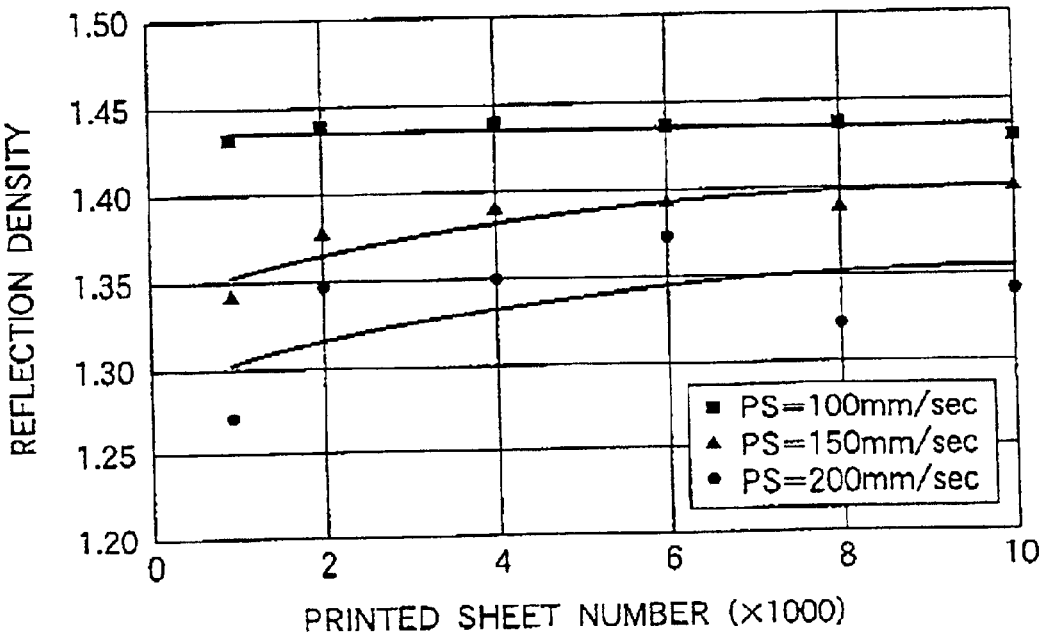
FIG. 9 is a graph showing the relationship between the number of printed sheets and the image-reflection density in the case where the conventional toner was used and the process speed was varied.

As a result, as shown in FIG. 3, the image-reflection density (reflection density obtained at a process speed of 150 mm/sec. when the ratio of the peripheral speed of the developing sleeve to that of the photosensitive drum in the developing section is set equal to 1.2:1) was significantly improved in comparison with the conventional toner shown in FIG. 9. The toner achieved a developing capability equivalent to that obtained when the conventional toner shown in FIG. 9 is used at a process speed of 100 mm/sec. and when the ratio of the peripheral speed of the developing sleeve to that of the photosensitive drum is set equal to 1.2:1.

What is claimed is:

1. An image forming apparatus comprising:

an electrophotographic photosensitive member;

charging means for applying voltage to a charge member to charge said electrophotographic photosensitive member;

electrostatic latent image forming means for forming an electrostatic latent image on the charged electrophotographic photosensitive member; and developing means for developing the electrostatic latent image, wherein said developing means is provided with at least a developer holding member having a developer holding member surface and configured to hold a one-component developer containing a toner on its developer holding member surface and a developer regulating member configured to regulate a layer thickness of a developer layer of the one-component developer on said developer holding member, wherein said electrophotographic photosensitive member and said developer holding member are set opposite to each other to form a developing section, wherein said developer regulating member regulates the one-component developer to form a thin layer of the one-component developer on the developer holding member surface, wherein in said developing section, the toner in the one-component developer is transferred to the electrostatic latent image held on the surface of said electrophotographic photosensitive member to form a toner image, wherein the peripheral speed of said electrophotographic photosensitive member is 150 mm/second or more, wherein the toner has a weight-average particle-diameter of from 5 to 12 $\mu$m, and of the toner having a circle-equivalent diameter of 3 $\mu$m or more, particles with a circularity a of 0.900 or more, found according to formula (1) are present at a rate of 90% or more in a number-based cumulative value, wherein $$\text{circularity } a = L0/L \quad (1),$$

wherein L0 denotes the circumference of a circle having the same projected area as a particle image, and L denotes the circumference of the particle image, and wherein the toner satisfies the following conditions I) or ii):

I) the relationship between a cut rate Z and a weight-average particle diameter X of the toner satisfies expression (2)

$$\text{cut rate } Z \leqq 5.3 \times X \quad (2),$$

wherein the cut rate Z is represented by expression (3)

$$Z = (1 - B/A) \times 100 \quad (3),$$

where A represents a concentration, defined as the number of particles/$\mu$l, of all particles measured with a flow-type particle image analyzer FPIA-1000 manufactured by TOA MEDICAL ELECTRONICS CO.,LTD., and B represents a concentration, defined as the number of particles/$\mu$l, of the measured particles the circle-equivalent diameters of which are 3 $\mu$m or more, wherein the relationship between a number-based cumulative value Y of particles having a circularity of 0.950 or more and a weight-average particle diameter X of the toner satisfies expression (4):

$$Y \geqq \exp 5.51 \times X^{-0.645} \quad (4),$$

where X is in the range from 5.0 to 12.0 $\mu$m; and ii) the relationship between a cut rate Z and a weight-average particle diameter satisfies expression (5)

$$\text{cut rate } Z > 5.3 \times X \quad (5)$$

and the relationship between a number-based cumulative value Y of particles having a circularity of 0.950 or more and a weight-average particle diameter X satisfies expression (6)

$$Y \geqq \exp 5.37 \times X^{-0.545} \quad (6),$$

where X is in the range from 5.0 to 12.0 $\mu$m, wherein the peripheral speed ratio of said developer holding member to said electrophotographic photosensitive member is 1.2 or less at said developing section.

2. The image forming apparatus according to claim 1, wherein said developer regulating member comprises an elastomeric member, and the free end of said developer regulating member is brought into contact with said developer holding member on the upstream side of said developer holding member relative to said developing section in the rotation direction of said developer holding member, forming the thin layer of the developer on said developer holding member surface.

* * * * *

UNITED STATES PATENT AND TRADEMARK OFFICE

CERTIFICATE OF CORRECTION

PATENT NO. : 6,823,159 B2
DATED : November 23, 2004
INVENTOR(S) : Hiroaki Sakai et al.

It is certified that error appears in the above-identified patent and that said Letters Patent is hereby corrected as shown below:

Title page,
Item [57], ABSTRACT, “valve” should read -- value --.

Column 3,
Lines 23 and 27, “speed” should read -- sleeve --.

Column 4,
Line 32, “expression” should read -- expression (5) --.
Line 49, “an” should read -- a --.

Column 9,
Line 32, “thus” should read -- thus, --.

Column 11,
Line 9, “power” should read -- powder --.
Line 12, “mechanism” should read -- mechanical --.
Line 46, “crushing-process” should read -- crushing process --.

Column 17,
Line 19, “HENSHELL” should read -- HENSCHEL --.

Column 18,
Line 5, “SHELL” should read -- SCHEL --.
Line 25, “though” should read -- through --.

Column 19,
Line 42, “HENSHELL” should read -- HENSCHEL --.

Column 22,
Line 54, “conditions I)” should read -- conditions i) --.
Line 56, “I)” should read -- i) --.

UNITED STATES PATENT AND TRADEMARK OFFICE

CERTIFICATE OF CORRECTION

PATENT NO. : 6,823,159 B2
DATED : November 23, 2004
INVENTOR(S) : Hiroaki Sakai et al.

It is certified that error appears in the above-identified patent and that said Letters Patent is hereby corrected as shown below:

Column 23,
Line 5, "more, wherein" should read -- more,
wherein -- (new paragraph).

Signed and Sealed this

Twelfth Day of April, 2005

JON W. DUDAS
*Director of the United States Patent and Trademark Office*